US011424553B2

(12) United States Patent
Popugaev et al.

(10) Patent No.: US 11,424,553 B2
(45) Date of Patent: Aug. 23, 2022

(54) CIRCUITRY

(71) Applicant: Fraunhofer-Gesellschaft zur Foerderung der angewandten Forschung e.V., Munich (DE)

(72) Inventors: Alexander Popugaev, Erlangen (DE); Mengistu Tessema, Erlangen (DE); Rainer Wansch, Erlangen (DE)

(73) Assignee: Fraunhofer-Gesellschaft zur Foerderung der angewandten Forschune e.V., Munich (DE)

( * ) Notice: Subject to any disclaimer, the term of this patent is extended or adjusted under 35 U.S.C. 154(b) by 0 days.

(21) Appl. No.: 16/943,809

(22) Filed: Jul. 30, 2020

(65) Prior Publication Data

US 2020/0366001 A1 Nov. 19, 2020

Related U.S. Application Data

(63) Continuation of application No. PCT/EP2019/052380, filed on Jan. 31, 2019.

(30) Foreign Application Priority Data

Feb. 1, 2018 (DE) ..... 102018201580.5

(51) Int. Cl.
*H01Q 21/24* (2006.01)
*H01P 5/22* (2006.01)
(Continued)

(52) U.S. Cl.
CPC ..... *H01Q 21/24* (2013.01); *H01P 5/227* (2013.01); *H01Q 9/0428* (2013.01); *H01Q 21/0006* (2013.01); *H01Q 9/0414* (2013.01)

(58) Field of Classification Search
CPC .. H01Q 21/24; H01Q 9/0428; H01Q 21/0006; H01Q 9/0414; H01P 5/227
See application file for complete search history.

(56) References Cited

U.S. PATENT DOCUMENTS 4,791,429 A 12/1988 Hannan
5,784,032 A 7/1998 Johnston et al.
(Continued)

FOREIGN PATENT DOCUMENTS

DE 3882430.2 T2 8/1993
DE 102009011542 A1 9/2010
(Continued)

OTHER PUBLICATIONS

Anaren, Inc, "", Model XC1400P-03S Rev C. East Syracuse, N.Y., US, [2011]. 24 S.—Firmenschrift. URL: https://cdn.anaren.com/product-documents/Xinger/90DegreeHybridCouplers/XC1400P-03S/XC1400P-03S_DataSheet(Rev_C).pdf, 2011.
(Continued)

*Primary Examiner* — David E Lotter
(74) *Attorney, Agent, or Firm* — Perkins Coie LLP; Michael A. Glenn

(57) ABSTRACT

A circuitry for feeding an antenna structure includes an input for LHCP signals, an input for RHCP signals as well as four antenna outputs. In addition, the circuitry includes first, second and third quadrature hybrids as well as at least two delay lines. The first quadrature hybrid is coupled, on the input side, to the first and second inputs and is coupled, on the output side, to the second and third quadrature hybrids. The second quadrature hybrid is coupled, on the output side, to two of the four antenna outputs, the third quadrature hybrid being coupled, on the output side, to two further ones of the four antenna outputs. The at least two delay lines are arranged at two of the four antenna outputs.

16 Claims, 18 Drawing Sheets

(51) Int. Cl.
*H01Q 9/04* (2006.01)
*H01Q 21/00* (2006.01)

(56) References Cited

U.S. PATENT DOCUMENTS

| | | | | |
|---|---|---|---|---|
| 6,618,016 | B1 | 9/2003 | Hannan et al. | |
| 7,852,279 | B2 | 12/2010 | Apostolos et al. | |
| 9,520,651 | B2 | 12/2016 | Astakhov et al. | |
| 2007/0254587 | A1 | 11/2007 | Schadler et al. | |
| 2007/0293150 | A1 | 12/2007 | Ezal et al. | |
| 2008/0316131 | A1* | 12/2008 | Apostolos | H01Q 21/24 343/756 |
| 2010/0253587 | A1 | 10/2010 | Lindenmeier et al. | |
| 2011/0050529 | A1 | 3/2011 | Popugaev et al. | |
| 2013/0101066 | A1 | 4/2013 | Dick | |
| 2016/0020521 | A1 | 1/2016 | Astakhov et al. | |

FOREIGN PATENT DOCUMENTS

| | | | |
|---|---|---|---|
| DE | 102007004612.1 | B4 | 4/2013 |
| EP | 2702634 | B1 | 8/2017 |

OTHER PUBLICATIONS

Karamzadeh, Saeid, et al., "Polarisation diversity cavity back reconfigurable array antenna for C-band application", IET Microwaves, Antennas & Propaga, The Institution of Engineering and Technology, United Kingdom, vol. 10, No. 9, Jun. 18, 2016 (Jun. 18, 2016), pp. 955-960,XP006056826, pp. 955-960.

Popugaev, A, et al., "An Efficient Design Technique for Direction-Finding Antenna Arrays", in Proceedings of IEEE-APS Topical Conference on Antennas and Propagation in Wireless Communications (APWC), Aruba, 2014.

Popugae, A., "Miniaturisierte Mikrosteifenleitungs-Schaltungen bestehend aus zusammengesetzten Viertelkreisringen", N&H Verlag, Erlangen, 2014 (Thesis, TU [University of Technology] Ilmenau), p. 17, 2014, p. 17.

Response Microwave, "Hybridline and Couplerline", Jan. 18, 2017 (Jan. 18, 2017), pp. 1-5, Retrieved from the Internet: URL:https://web.archive.org/web/20170118182856/http://www.responsemicrowave.com/Products_Services/hybrids_couplers.php, XP055578268XP055578268, Jan. 18, 2017, pp. 1-5.

Sanz Subirana, J. et al., "GNSS Data Processing, vol. I: Fundamentals and Algorithms", ESA Communications, ESA TM-23/1, May 2013, May 2013.

* cited by examiner

CIRCUITRY

CROSS-REFERENCES TO RELATED APPLICATIONS

This application is a continuation of copending International Application No. PCT/EP2019/052380, filed Jan. 31, 2019, which is incorporated herein by reference in its entirety, and additionally claims priority from German Application No. DE 102018201580.5, filed Feb. 1, 2018, which is incorporated herein by reference in its entirety.

BACKGROUND OF THE INVENTION

Embodiments of the present invention relate to a circuitry (circuit assembly) for feeding an antenna structure and to an antenna arrangement comprising corresponding circuitry. Advantageous embodiments relate to a feeding network comprising extended bandwidth for dual and single circular polarizing antenna structures.

In many applications, circular polarization offers the advantage that polarization tracking may be dispensed with. For example, the signals of global navigation systems (GNSS) are right hand circular polarized (RHCP). In this connection, reference shall be made to FIG. 6, which presents the GNSS signals in the L band. Here, different types of hatching designate the bands of the individual GNSS systems (GPS—marked by reference numeral L, GLONASS—marked by reference numeral G, Galileo—marked by reference numeral E, and Beidou—marked by reference numeral B.

In several interference scenarios, e.g. when there are strong multi-path interferences or when applying spoofing attacks, increased robustness and reliability of GNSS reception may be made possible by additionally assessing the orthogonally polarized component. The orthogonally polarized component is left hand circular polarized (LHCP), for example.

In conventional technology this is made possible, for example, by employing an additional LHCP antenna. Alternatively, it is also possible to employ an additional output for the LHCP component and/or a dual circular polarized antenna. The latter is particularly advantageous for reasons of cost and size.

From patent literature U.S. Pat. No. 7,852,279, a phasing module is known, which includes 180-degrees and 90-degrees hybrids. In addition, reference shall be made to the published applications US 2007/293150 A1, US 2008/316131 A1 and US 2016/020521 A1. A further publication is known by the title of "Hybridline and Couplerline". In addition, the publication "Polarisation diversity cavity back reconfigurable array antenna for C-band application" constitutes a further disclosure of conventional technology. Moreover, reference shall also be made to U.S. Pat. No. 5,784,032 A.

Numerous variants of the feeding networks for single (RHCP or LHCP) circular polarized antennas, e.g. having cardioid-shaped directional characteristics, have been known from literature. Such cardioid-shaped directional characteristics in the TM11 mode are depicted, for example, in FIG. 7*c*. Depending on the implementation of the radiator (whether symmetric or asymmetric), excitation is effected at one, two or four feeding points.

Antennas comprising four-point feeding are of particular interest since they enable relatively large bandwidths not only with regard to impedance matching, but also in terms of directional characteristics, polarization behavior (axial ratio of the polarization ellipse) and phase center variation (essential for high-quality GNSS antennas). FIGS. 7*a* and 7*b* present a broad-band representative of antennas comprising four-point feeding (cf. [2] and [3]), whereas FIGS. 7*d* to 7*f* show multi-band configurations (cf. [4] and [5]), which will be explained below with reference to FIG. 7*g*.

FIG. 7*g* illustrates a feeding network architecture 1 for single circular polarized antennas (four-point feeding for an RHCP network). The feeding network 1 includes a first quadrature hybrid 12 arranged, on the input side, at the feeding network 1 (cf. input 1*e*) as well as second and third quadrature hybrids 14 and 16 arranged on the output side (cf. antenna outputs 1*a*1, 1*a*2, 1*a*3 and 1*a*4). Each of said quadrature hybrids 12, 14 and 16 includes two inputs 12*e*1 and 12*e*2, 14*e*1 and 14*e*2, and 16*e*1 and 16*e*2, respectively, as well as two outputs 12*a*1 and 12*a*2, 14*a*1 and 14*a*2, and 16*a*1 and 16*a*2, respectively. Each quadrature hybrid may forward a signal, received via any of the inputs 12*e*1 to 16*e*2, at any of the outputs 12*a*1 to 16*a*1 with a phase offset, as well as at any of the outputs 12*a*2 to 16*a*2 without any phase offset.

The feeding network 1 has the quadrature hybrid 12 provided at the input 1*e*, said quadrature hybrid 12 being connected to the outputs 1*a*1 and 1*a*2 via the quadrature hybrid 14. In addition, the quadrature hybrid 12 is connected to the outputs 1*a*3 and 1*a*4 via the hybrid 16. In detail: the first quadrature hybrid 12 is arranged on the input side and obtains an RHCP signal via the output 12*e*1; the second output 12*e*2 is to be seen as terminated (cf. termination resistor 5). The quadrature hybrid 12 forwards the RHCP signal to the output 12*a*1 at a phase offset of 90 degrees and to the output 12*a*2 without any phase offset. The output 12*a*1 is connected to the input 14*e*1 of the second quadrature hybrid 14 via a delay line 7 (phase offset delay of 90 degrees). The second input of the quadrature hybrid 14, namely the input 14*e*2, is terminated (cf. termination resistor 5). The outputs of the second quadrature hybrid 14 are connected to the outputs 1*a*1 and 1*a*2 (14*a*1 at 1*a*1 and 14*a*2 at 1*a*2). One of the two outputs 14*a*1 and 14*a*2, namely the output 14*a*2, added a further phase offset of 90 degrees. As a result of the phase offset of the first quadrature hybrid 12 by 90 degrees, of the phase offset of the delay line by 97 degrees and, consequently, of the phase offset of the output 14*a*2 (90-degrees output), the signal is phase-offset by 270 degrees at the output 1*a*2, whereas the output signal is phase-offset by 180 degrees at the 0-degree output 14*a*1 connected to the antenna output 1*a*1. The third quadrature hybrid 16 is coupled, with its input 16*a*1, to the output 12*a*2 of the first quadrature hybrid 12, whereas the second input 16*e*2 is terminated (cf. termination resistor 5). The outputs 14*a*1 (0-degree output) and 16*a*2 (90-degrees output) are coupled to the antenna outputs 1*a*3 and 1*a*4 (16*a*1 to 1*a*3 and 16*a*2 to 1*a*4). The RHCP signal is phase-offset by 0 degrees at the output 1*a*3 as a result of this arrangement, whereas it is phase-offset by 90 degrees in the output 1*a*4 (offset is effected by the third quadrature hybrid 16).

By means of this four-point feeding network 1 explained here, the antenna depicted in FIGS. 7*a* and 7*b* may also be operated, for example, provided that hybrid couplers are employed which are designed for operation within the entire GNSS frequency range in the L band (cf. FIG. 6). Such quadrature hybrids (designed for 1200 to 1600 MHz) are disclosed in [6].

In contrast to the feeding network topology of FIG. 7*g*, only very few topologies have been known which enable feeding of dual circular polarized antenna structures.

FIG. 7*h* shows a feeding network topology comprising RHCP and LHCP modes. Here, two-point feeding is assumed. The feeding network 2 of FIG. 7*h* includes an input 2*e* designed for LHCP and RHCP signals, as well as two outputs 2*a*1 and 2*a*2. A quadrature hybrid 12 is connected therebetween. At this quadrature hybrid 12, LHCP signals are received via the input 12*e*1, whereas RHCP signals are received via the input 12*e*2. The output 12*a*1 (90-degrees output) is connected to the antenna output 2*a*2, whereas the output 12*a*2 (0-degree output) is connected to the antenna output 2*a*2. Partitioning of power in equal parts (ideally, −3 dB in each case) is effected with the aid of the quadrature hybrid 12 exhibiting a phase offset of ±90 degrees. Here, the quadrature hybrid of [6] may be used. The resulting amplitude assignment and phase assignment are depicted in FIG. 7*i*—the quadrature hybrid of [6] shall be assumed as the basis.

The top of FIG. 7*i* shows the magnitude that is plotted across the frequency, whereas the bottom of FIG. 7*i* shows the transmission parameter phase plotted across the frequency.

The argument of the complex transmission factor S41 at the center frequency $f_0$ is designated by $-\theta_0$. The implementable bandwidth of patch antennas thus fed, with regard to the shape of the directional characteristic and cross polarization suppression, however, is clearly smaller than with a four-point fed antenna with, e.g., the feeding network 1 of FIG. 7*g*. Also in the case of multi-band stack patch antennas, the bandwidth amounts to several percent only in each case.

This is why there is the need for feeding networks which are broad-band and capable of RHCP and LHCP operation at the same time.

SUMMARY

According to an embodiment, a circuitry for feeding an antenna structure may have: a first input for LHCP signals, a second input for RHCP signals; four antenna outputs; a first quadrature hybrid; second and third quadrature hybrids, and at least two delay lines; wherein the first quadrature hybrid is coupled, on the input side, to the first and second inputs and is coupled, on the output side, to the second and third quadrature hybrids, wherein the second quadrature hybrid is coupled, on the output side, to two of the four antenna outputs, and wherein the third quadrature hybrid is coupled, on the output side, to two further ones of the four antenna outputs; wherein the at least two delay lines are arranged at two of the four antenna outputs; the circuitry including fourth and fifth quadrature hybrids connected in series, the fourth quadrature hybrid being connected, on the input side, to the second quadrature hybrid and to the third quadrature hybrid.

According to another embodiment, an antenna arrangement may have: an antenna structure including four feeding points; an inventive circuitry, the four outputs being connected to the four feeding points of the antenna structure.

According to yet another embodiment, a circuitry for feeding an antenna structure may have: a first input for LHCP signals, a second input for RHCP signals; four antenna outputs; a first quadrature hybrid; second and third quadrature hybrids, and at least two delay lines; wherein the first quadrature hybrid is coupled, on the input side, to the first and second inputs and is coupled, on the output side, to the second and third quadrature hybrids, wherein the second quadrature hybrid is coupled, on the output side, to two of the four antenna outputs, and wherein the third quadrature hybrid is coupled, on the output side, to two further ones of the four antenna outputs; wherein the at least two delay lines are arranged at two of the four antenna outputs.

Embodiments of the present invention provide a circuitry for feeding an antenna structure. The circuitry includes a first input for LHCP signals, a second input for RHCP signals, as well as four antenna outputs. The switching network has first, second and third quadrature hybrids and at least two delay lines provided between the inputs and outputs. The first quadrature hybrid is coupled, on the input side, to the first and second inputs and is coupled, on the output side, to the second and third quadrature hybrids. The second quadrature hybrid is coupled, on the output side, to two of the four antenna outputs, and the third quadrature hybrid is coupled, on the output side, to two further ones of the four antenna outputs. The at least two delay lines are arranged at two of the four antenna outputs, e.g. at the second and third or at the first and fourth one.

Embodiments of the present invention are based on the finding that by means of a circuitry having at least three quadrature hybrids and at least two delay lines, a feeding network comprising two predefined signal paths may be provided which (firstly) exhibits an extended bandwidth, and (secondly) may be employed both for dual (first and second paths) and for single circular polarizing (first or second path) antenna structures. In this manner, the disadvantages discussed with regard to conventional technology are fully avoided. Due to the small number of components, the feeding network is also easy to set up. In accordance with the advantageous implementation, the feeding network is configured to drive antennas of up to four feeding points.

Subsequently, variants of the circuit in accordance with embodiments will be explained: in accordance with one embodiment, the second quadrature hybrid may be directly coupled, on the output side, to the first of the four antenna outputs, and the quadrature hybrid may be directly coupled, on the output side, to the fourth of the four antenna outputs. In accordance with further embodiments, delay lines are provided for coupling the third and fourth antenna outputs to the second and third quadrature hybrids.

Further embodiments provide a circuitry comprising five quadrature hybrids. For said circuitry one shall assume the above-explained base topology, the fourth of the five quadrature hybrids and the fifth of the five quadrature hybrids being connected in series and being connected, on the input side, to an output of the second and third quadrature hybrids, respectively, specifically in such a manner that the second and third quadrature hybrids are coupled to the antenna outputs 2 and 3 via the fourth and fifth quadrature hybrids. In this embodiment, e.g., the delay lines are provided at the antenna outputs 1 and 4 or, alternatively, at the antenna outputs 2 and 3, or at all four antenna outputs. This variant of the feeding network comprising the multi-layer setup advantageously enables application thereof with specific types of antennas, such as aperture-coupled antennas comprising annular slots.

In all of the above embodiments, a quadrature hybrid comprising two inputs and two outputs may be employed as the first, second, third as well as fourth and fifth quadrature hybrid. With its first input, the first quadrature hybrid forms, on the input side, the first input for LHCP signals, and with its second input, it forms the second input for RHCP signals. On the output side, an input of the second and third quadrature hybrids, respectively, are coupled via the two outputs of the first quadrature hybrid. In accordance with further embodiments, the respectively other input of the second and third quadrature hybrids is terminated by means of a termination resistor. In accordance with one embodiment, the outputs of the quadrature hybrids, or the quadrature hybrids themselves, are configured to generate, during forwarding of the signals from the input side to the output side, a phase offset at 0 degrees at one of the outputs and to generate a phase offset at 90 degrees at a different one of the two outputs. In a further variant comprising five quadrature hybrids, the fourth quadrature hybrid is coupled, e.g., to the 0-degree output of the second and third quadrature hybrids.

In accordance with embodiments, the circuitry is configured to be operated in the RHCP mode and in the LHCP mode. In the RHCP mode, the second quadrature hybrid obtains from the first quadrature hybrid a signal offset by 90 degrees by the first quadrature hybrid, whereas the third quadrature hybrid obtains from the first quadrature hybrid a signal offset by 0 degrees by the first quadrature hybrid. Conversely, in the LHCP mode, the third quadrature hybrid obtains from the first quadrature hybrid a signal offset by 90 degrees by the first quadrature hybrid, whereas the second quadrature hybrid obtains from the first quadrature hybrid a signal offset by 0 degrees by the first quadrature hybrid. In accordance with further embodiments, in the RHCP mode, the first input is terminated by means of a termination resistor, whereas in the LHCP mode, the second input is terminated by means of a termination resistor.

Further embodiments relate to an antenna arrangement comprising, e.g., four feeding points as well as a circuitry as was explained above.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
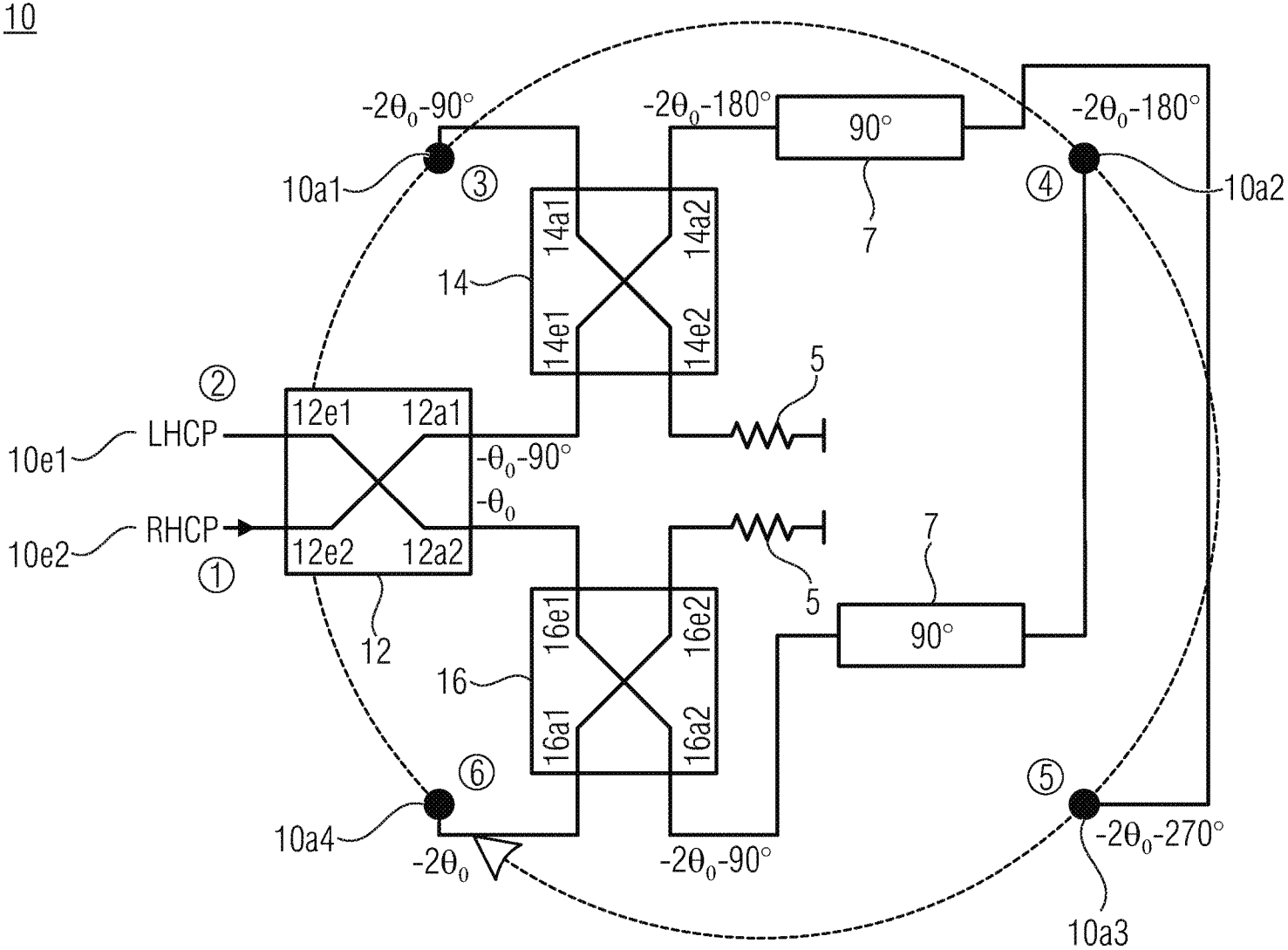
FIG. 1 shows a schematic block diagram of a circuitry for four-point feeding in accordance with a basic embodiment.

Before embodiments of the present invention will be explained below by means of the accompanying drawings, it shall be noted that elements and structures which are identical in action are provided with identical reference numerals so that their descriptions are interchangeable and/or mutually applicable.

FIG. 1 shows a circuitry 10 comprising two inputs 10*e*1 and 10*e*2 as well as four outputs 10*a*1 to 10*a*4. The circuitry 10 further comprises three quadrature hybrids 12 to 16 in total. The first quadrature hybrid 12 is arranged on the input side, i.e. at the inputs 10*e*1 and 10*e*2, whereas the third and fourth quadrature hybrids 14 and 16 are arranged on the output side.

The quadrature hybrids 14 and 16 are directly coupled, with one of their inputs (14*e*1 and 16*e*1, respectively) to the outputs 12*a*1 and 12*a*2 of the first quadrature hybrid 14. In detail, the second quadrature hybrid 14 connects the output 12*a*1 of the first quadrature hybrid to the output 10*a*1 and to the output 10*a*3, whereas the third quadrature hybrid 16 couples the output 12*a*2 of the first quadrature hybrid 12 to the outputs 10*a*2 and 10*a*4. The second inputs 14*e*2 and 16*e*2, respectively, are terminated via a termination resistor (e.g. 50 ohm and 50 ohm system).

In this embodiment, a delay line 7 having a specific length on which the delay depends is provided between the second quadrature hybrid 14 and the third antenna output 10*a*1 as well as between the third quadrature hybrid 16 and the second antenna output 10*a*1, respectively. Coupling of the antenna outputs 2 and 3, or 10*a*2 and 10*a*3, is effected via the quadrature hybrid outputs 14*a*2 and 16*a*2, respectively, which are phase-offset by 90 degrees, with the interconnected delay line 7. The antenna outputs 1 and 4, or 10*a*1 and 10*a*4, are directly connected via the zero-degree quadrature hybrid outputs 14*a*1 and 16*a*1, respectively.

Depending on whether an LHCP signal is applied across the input 10*e*1 (formed across the quadrature hybrid input 12*e*1) or an RHCP signal is applied across the input 10*e*2 (formed across the quadrature hybrid input 12*e*1), the feeding network depicted here may be operated in the RHCP mode or in the LHCP mode, as will be explained below. In accordance with embodiments, the respectively other input 12*e*1 and 12*e*2 will then be terminated with a termination resistor accordingly. For example, if an RHCP signal is applied across the inputs 10*e*2 and 12*e*2, respectively, said signal will be phase-offset by 90 degrees by the quadrature hybrid 12 at the input 12*a*1, said signal then being forwarded, on the one hand, by the quadrature hybrid 14, directly to the output 10*a*1 by means of the output 14*a*1 and being forwarded, on the other hand, to the delay line 7 (90 degrees delay) via the output 14*a*2 in a manner in which it is phase-offset by another 90 degrees. Said delay line will perform a further phase offset, so that as a result, a signal phase-offset by 270 degrees will be applied at the output 10*a*3. The second bundle of signals starting from the first quadrature hybrid 12 extends, across the input 12*a*2, which is phase-offset by 0 degrees, to the third quadrature hybrid 16, which forwards the signal without any delay at the 0-degrees output 16*a*1 to the antenna output 10*a*4, the signal being forwarded to the delay element 7 (90 degrees delay) across the 90-degrees output 16*a*2 of the quadrature hybrid 16. Said delay element 7 performs repeated delay, so that a signal delayed by 180 degrees will then be applied at the second antenna output 10*a*2. In the LHCP mode (application of a signal at the input 10*e*1 and 12*e*1, respectively), the phase shifts present at the outputs 12*a*1 and 12*a*2 are reversed, namely so that the output 12*a*1 forms the 0-degrees output, and the output 12*a*2 forms the 90-degrees output. As a result, a signal phase-offset by 90 degrees (phase offset caused by the first quadrature hybrid 12) will then be applied at the output 10*a*4, a signal phase-offset by 180 degrees (phase offset caused by the second quadrature hybrid 14 and the delay line 7) will be applied at the output 10*a*3, a signal phase-offset by 270 degrees (phase offset of 90 degrees caused by the delay line 7, phase offset of 90 degrees caused by the third quadrature hybrid 16, and phase offset of 90 degrees caused by the first quadrature hybrid 12) will be applied at the output 10*a*2, and a signal offset in phase by 0 degrees will be applied at an output 10*a*1 (forwarding across 0-degrees output at 12 and 14). All in all, the arrangement 10 as well as the wiring of its components 7, 12, 14 and 16 as well as 10*a*1 to 10*a*4 may be regarded as being symmetric. It shall be noted here that reverse application of RHCP to 10*e*1 and of LHCP to 10*e*2 would also be possible, of course.

Due to its symmetry, the architecture 10 is also suitable for feeding dual circular polarized antennas. If one assumes that broad-band hybrids 12, 14 and 16 are employed, correspondingly large bandwidths, specifically with regard to the shape of the directional characteristic and cross-polarization suppression, may also be achieved. In this context, please refer to the diagrams of FIGS. 2*a* and 2*b*, for example.

Figure 2A:
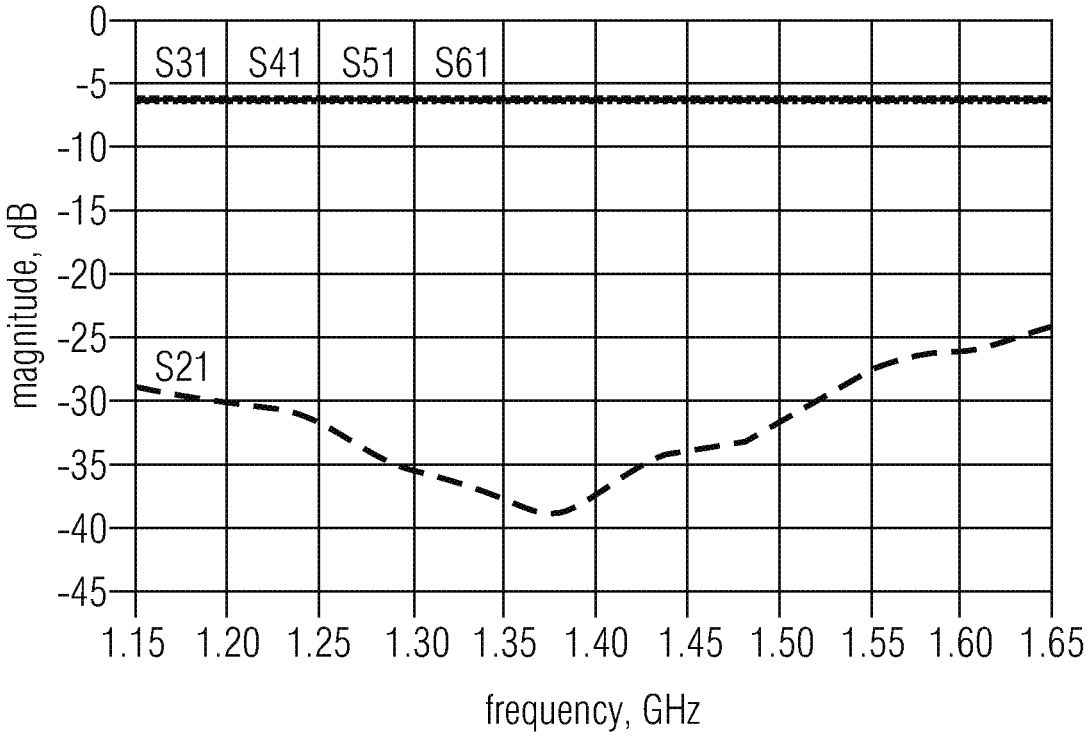
FIGS. 2*a*, 2*b* show schematic diagrams for illustration by means of transmission parameters of the circuitry of FIG. 1.
Figure 2B:
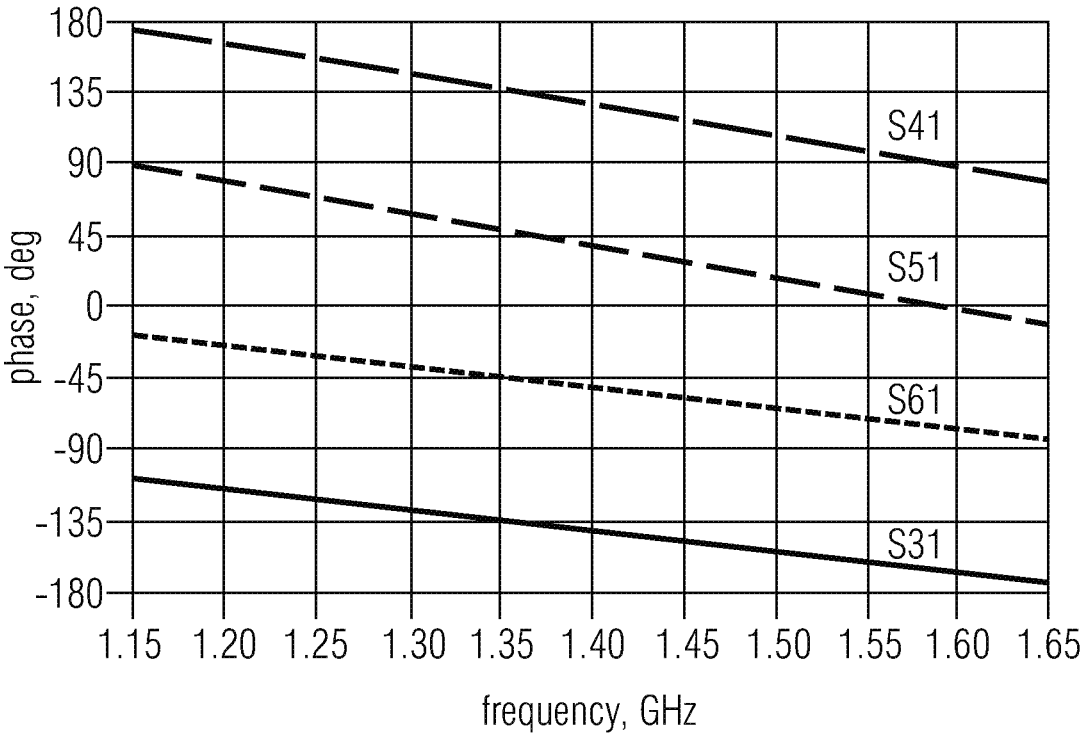

FIG. 2*a* shows the magnitude, plotted across the frequency, whereas FIG. 2*b* shows the phase plotted across the frequency. As can be seen, the magnitudes of the antenna out-puts, which are designated by reference numerals S31 to S61, are constant, which enables broadbandedness as compared to the above-explained diagram 7*i*. S21 illustrates coupling between the inputs 10*e*1 and 10*e*2 (between −25 and −38 dB, i.e. insulation between +25 and +28 dB).

Figure 3A:
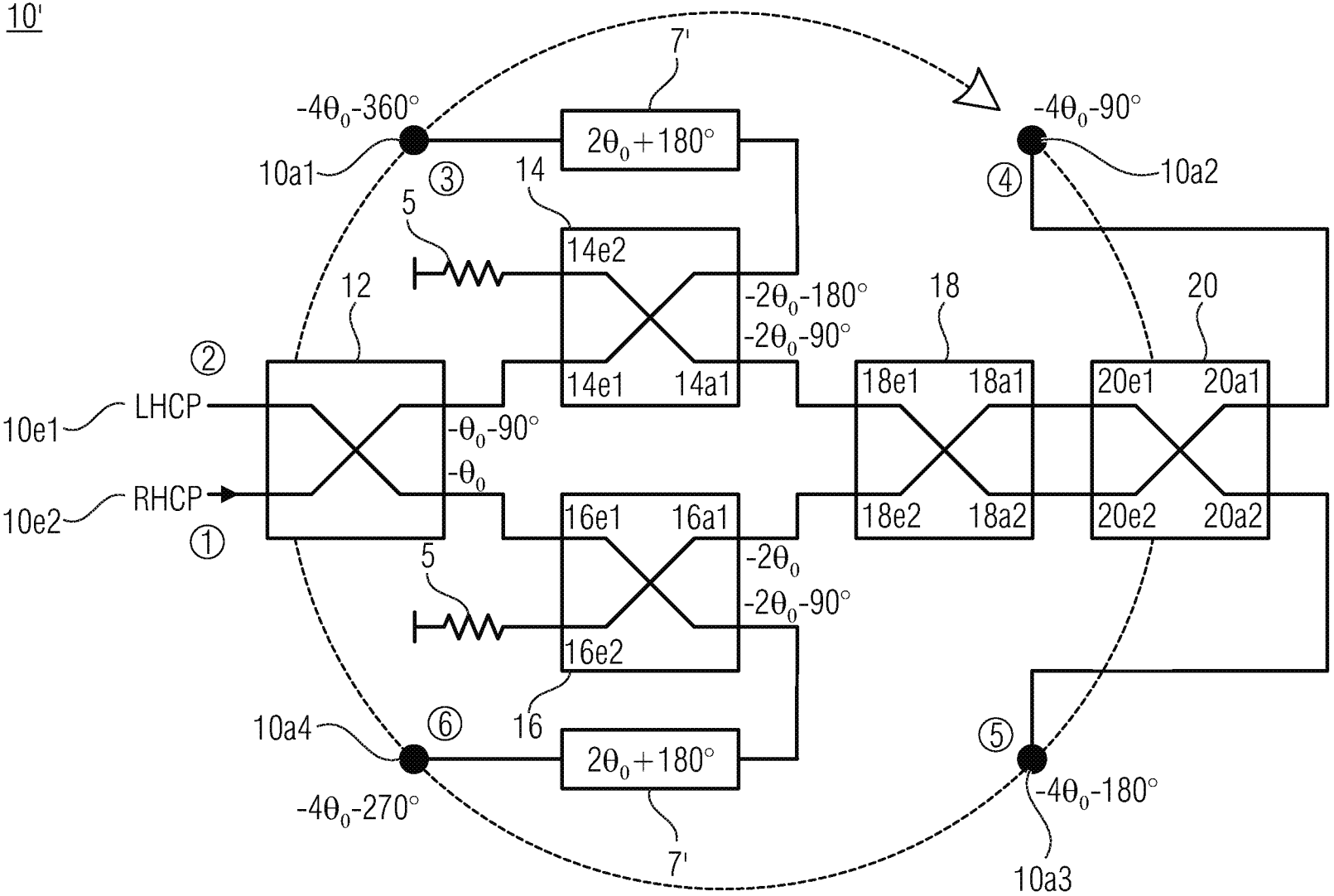
FIGS. 3*a-c* show schematic block diagrams of circuitries in accordance with extended embodiments.

FIG. 3*a* shows a further circuitry 10' comprising the inputs 10*e*1, 10*e*2 as well as the outputs 10*a*1 to 10*a*4. The circuitry 10' comprises the two quadrature hybrids 12, 14 and 16 as well as two additional quadrature hybrids 18 and 20, which are coupled to the outputs 14*a*1 and 16*a*1 (phase outputs of zero in each case) with the inputs 18*e*1 and 18*e*2 of the fourth quadrature hybrid 18. The fifth quadrature hybrid 20 is coupled, with its inputs 20*e*1 and 20*e*2, to the outputs 18*a*1 and 18*a*2. In terms of the connection between the second and first quadrature hybrids 14, 12 and the third and first quadrature hybrids 16 and 12, respectively, please refer to the explanations given within the context of the embodiment of FIG. 1. By analogy with the embodiment of FIG. 1, the inputs 14*e*2 and 16*e*2 are terminated by means of termination resistors 5. On the output side, the quadrature couplers 14 are coupled to the outputs 10*a*1 and 10*a*4 via a delay line 7', respectively, which here may be, e.g., a 180-degrees delay line (ideally, if $\theta_0=0$). Conversely, the outputs 10*a*2 and 10*a*3 are connected directly to the outputs 20*a*1, 20*a*2. As compared to the circuitry 10 of FIG. 1, the circuitry 10' is supplemented by a cross coupler made of two cascaded hybrids. Just like the four-point feeding network of FIG. 1, said variant offers the possibility of supplying a broad-band GNSS antenna via four feeding points in the RHCP and LHCP modes. This more complex circuit 10' will advantageously be employed when the circuit variant 10 cannot be readily used, e.g. in the event of an aperture-coupled antenna comprising an annular slot. Consequently, for some applications the slightly more complex feeding network arrangement 10' is the better choice.

Figure 3B:
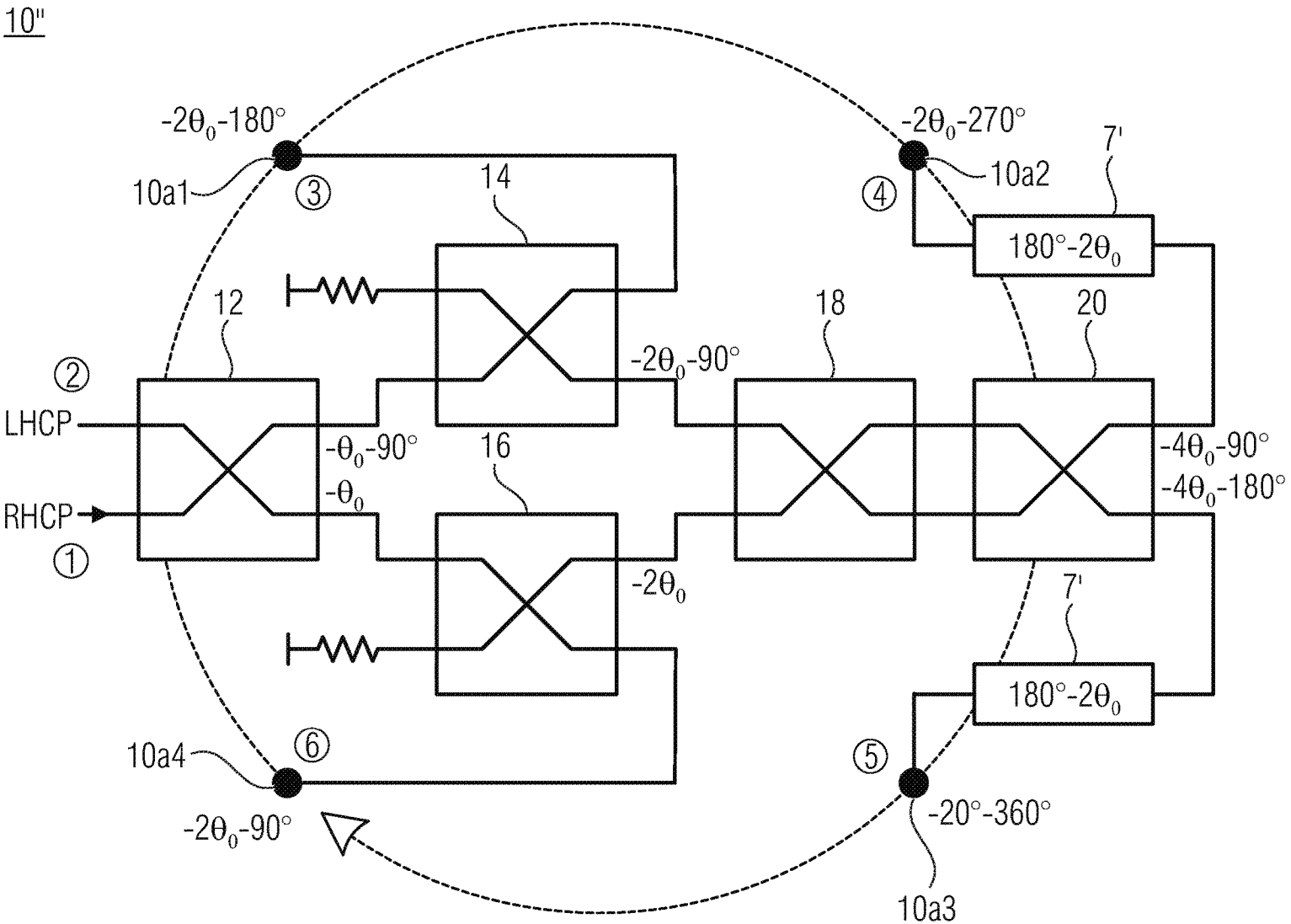

FIG. 3*b* shows a feeding network 10" (intermediate step, narrow-band implementation), which is essentially comparable to the feeding network 10', specifically with regard to the quadrature hybrids 12, 14, 16, 18, and 20. The difference consists in that the delay elements 7' are arranged at the outputs 10*a*2 and 10*a*3 rather than at the outputs 10*a*1 and 10*a*4. It shall be noted at this point that, again, 180-degrees delay elements (represents the ideal case, if $\theta_0=0$) are employed here.

Figure 3C:
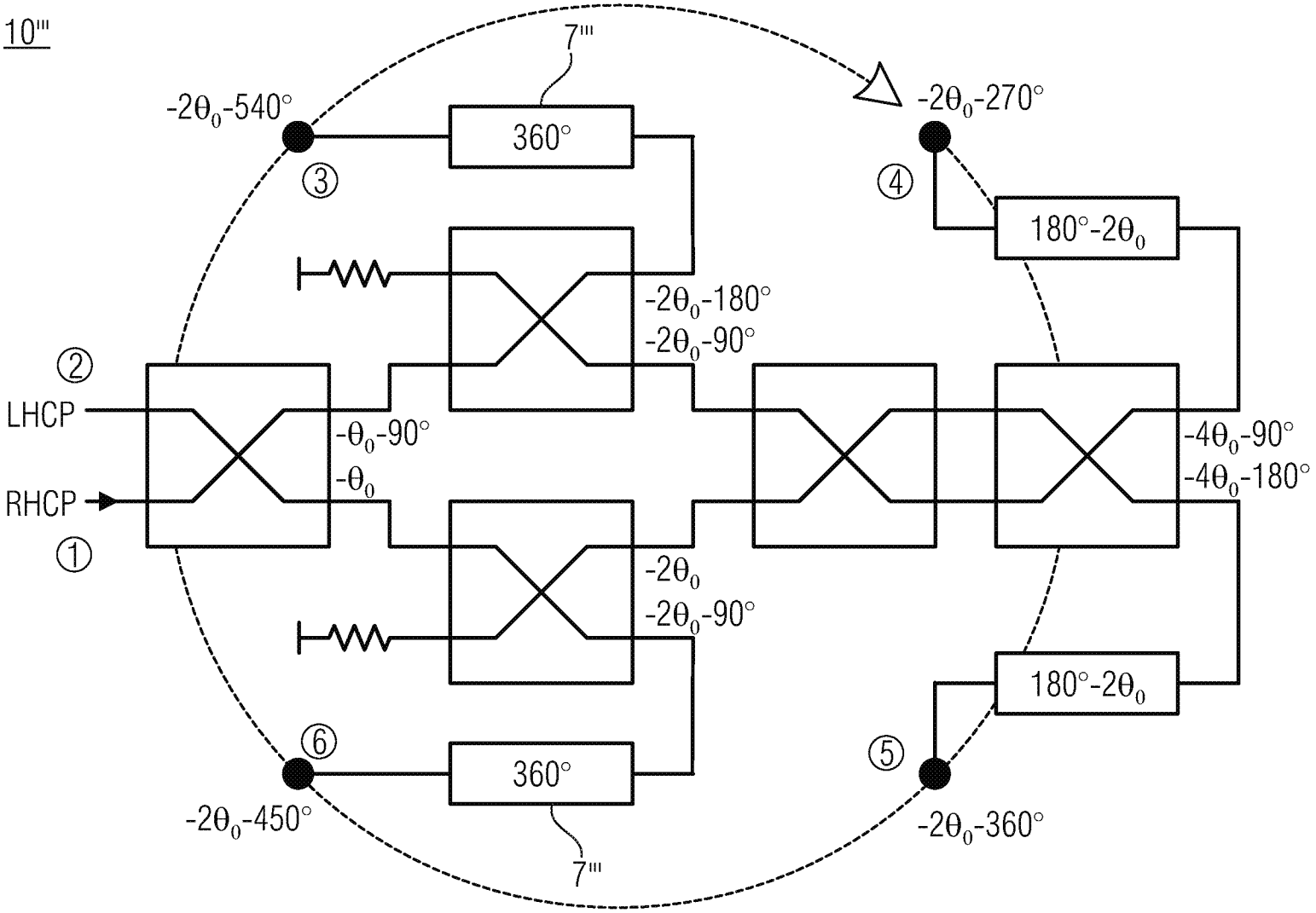

FIG. 3*c* shows a further feeding network topology 10'", which is comparable to the feeding network topology 10"; however, delay lines 7'", here 360-degrees delay lines, are provided at the outputs 10*a*1 and 10*a*4. Said delay lines serve to achieve additional runtime compensation, which is advantageous, in particular, for broad-band operation of such cross-coupled, cascaded hybrids. The feeding network topology 10'" is equivalent to 10', all four delay lines being shortened by ($180°-2\theta_0$), respectively.

Figure 4A:
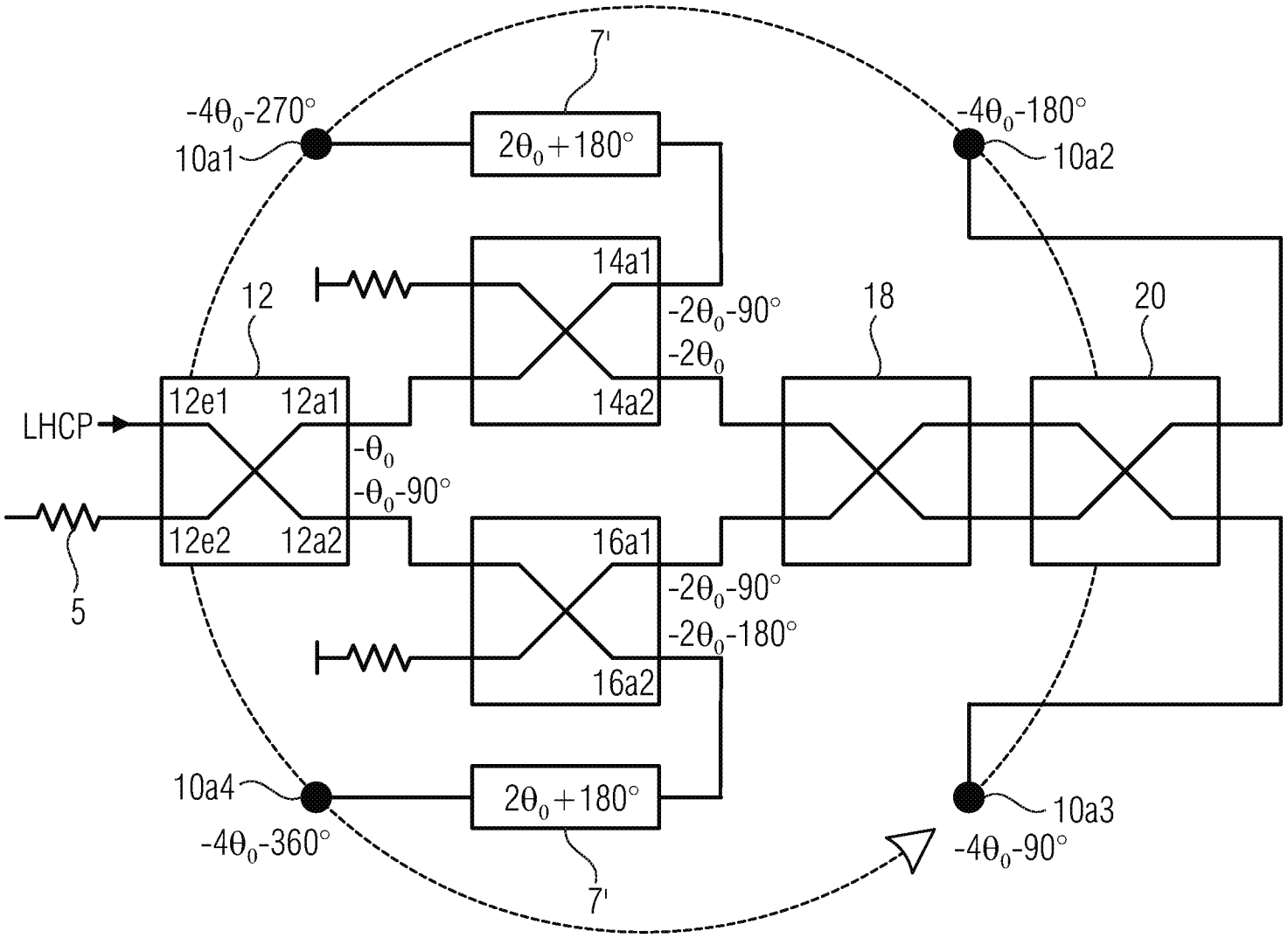
FIGS. 4*a*, 4*b* show schematic block diagrams for illustrating the different modes (RHCP and LHCP) with the circuitry of FIG. 3*a;*
Figure 4B:
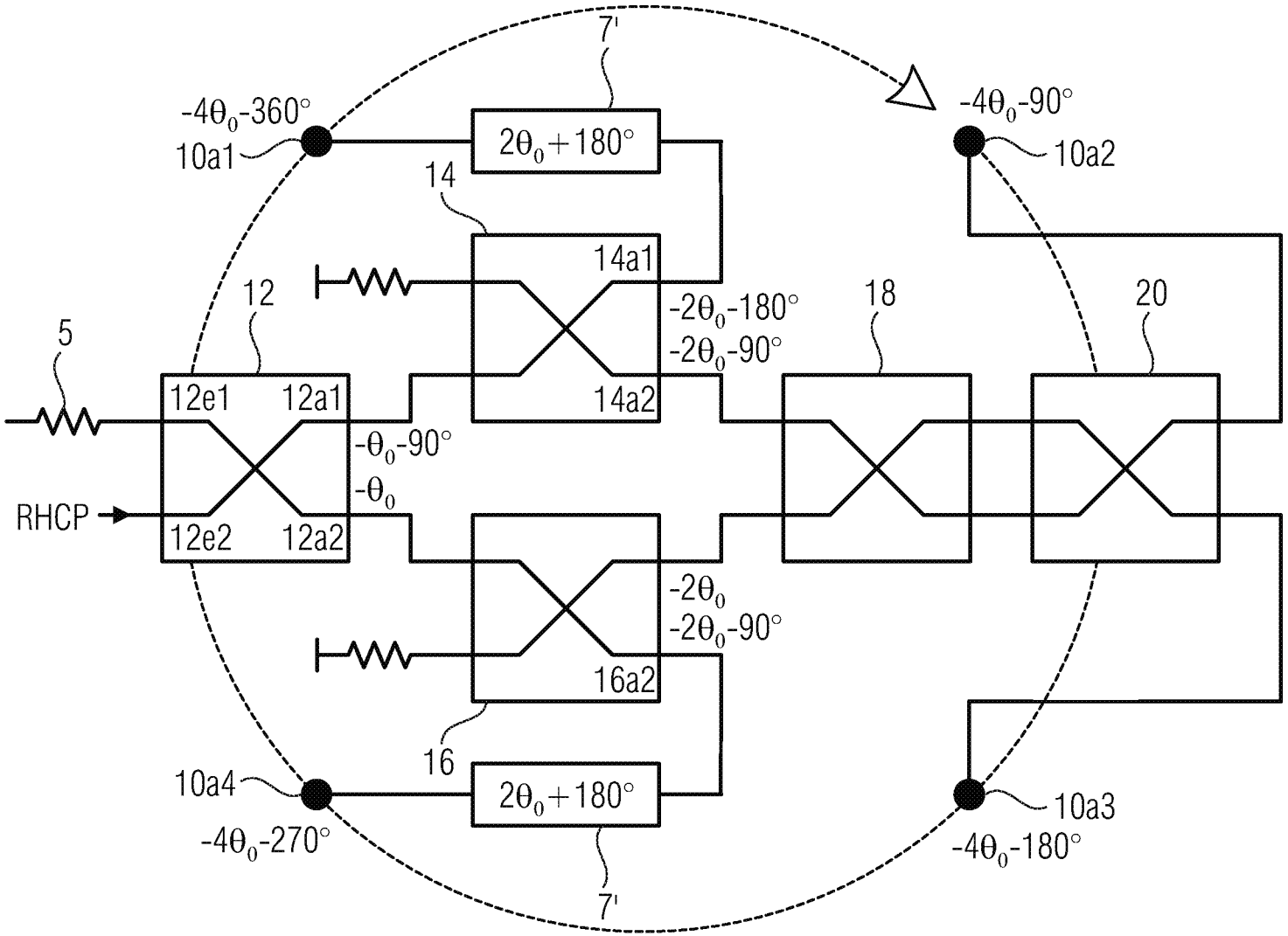

In FIGS. 4*a* and 4*b*, the RHCP mode as well as the LHCP mode are illustrated on the basis of the circuit topology 10' of FIG. 3*a*. In the RHCP mode (cf. FIG. 4*a*), the signal is received via the input 12*e*2, whereas the input 12*e*1 is terminated by means of the termination resistor 5. The RHCP signal will then be phase-shifted by 90 degrees, respectively, at the output 12*a*1 as well as at the output 14*a*1, and is phase-shifted by 180 degrees at the delay element 7' so as to then be output, at the output 10*a*1, as a 63-degrees signal. At the output 14*a*2 it will be available as a signal phase-shifted by 90 degrees and will then be output, on the basis of having been offset twice by the hybrids 18 and 20, at the output 10*a*3 as a 180-degrees signal. The signal provided as 0 degrees at the output 12*a*2 is supplied to the hybrids 18 and 20 as a 0-degree signal and is output, after a one-off phase shift, as a 90-degrees signal at the output 10*a*2. Said 0-degree signal of the output 12*a*2 is provided, in a phase-shifted manner, as a signal phase-shifted by 90 degrees by the hybrid 16 at the output 16*a*2 and will be made available, following phase-shifting by the element 7', at the output 10*a*4 as a 270-degrees signal. This results in a right hand signal as is illustrated by the arrows.

FIG. 4*b* illustrates the LHCP mode, wherein the LHCP signal is maintained at the input 12*e*1. Here, the input 12*e*2 is terminated by the termination resistor 5. On the basis of this signal, a phase shift by 0 degrees occurs at the output 12*a*1, a phase shift of 90 degrees occurs at the output 14*a*1, and a further phase shift by 180 degrees is effected by the delay element 7', so that the signal is then provided at the output 10*a*1 as a 270-degrees signal. The signal of the output 12*a*1 is forwarded as a 0-degree signal to the input 14*a*2 and will then be made available to the output 10*a*3 as a 90-degrees signal after having been phase-shifted once. The hybrid 12 forwards the signal to the output 12*a*2 as a 90-degrees signal, which will then also be provided to the hybrids 18 and 20 at the output 16*a*1 as a 90-degrees signal. By means of said hybrids 18 and 20, a further 90-degrees phase-shift occurs, so that a 180-degrees signal will be applied at the output 10*a*2. At the output 10*a*4, a 360-degrees signal will be applied which is composed by the fact that the signal at the output 12*a*2 undergoes a 90-degrees phase shift and will undergo a further 90-degrees phase shift at the output 16*a*2. By means of the delay element 7' at the output 10*a*4, an additional shift by 180 degrees is effected. As is illustrated by this case, what is at hand as a result of this wiring is a right-hand drive.

Figure 4C:
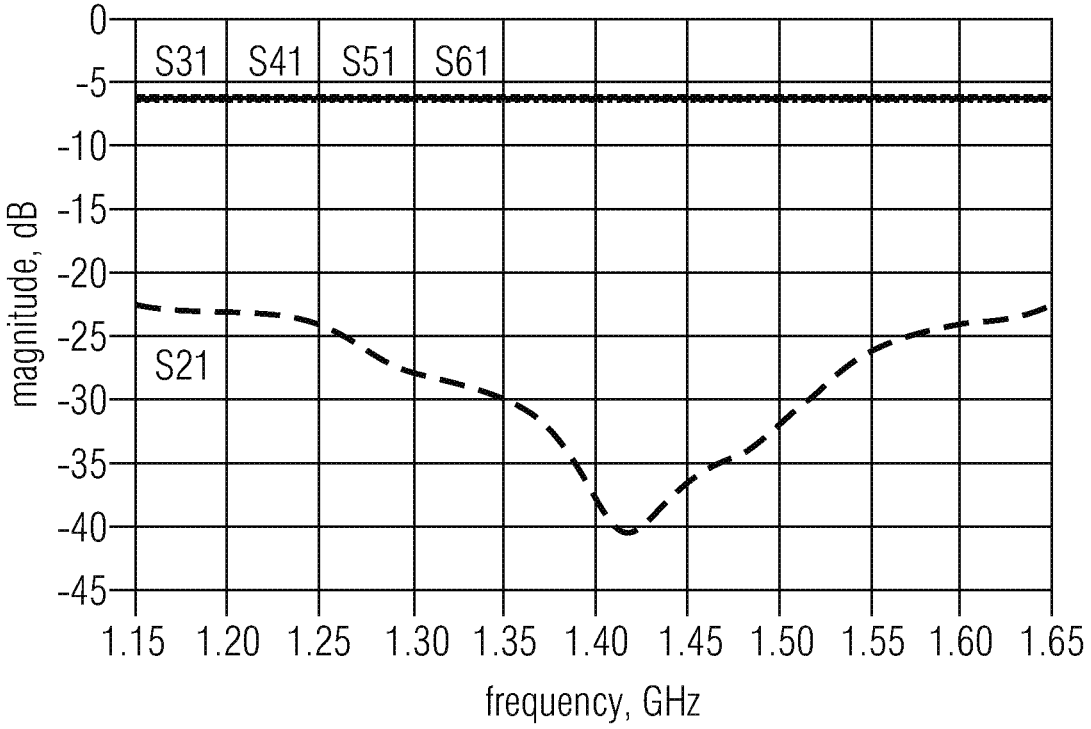
FIGS. 4*c*, 4*d* show schematic diagrams for illustrating the transmission parameters of the circuitry of FIG. 3*a;*
Figure 4D:
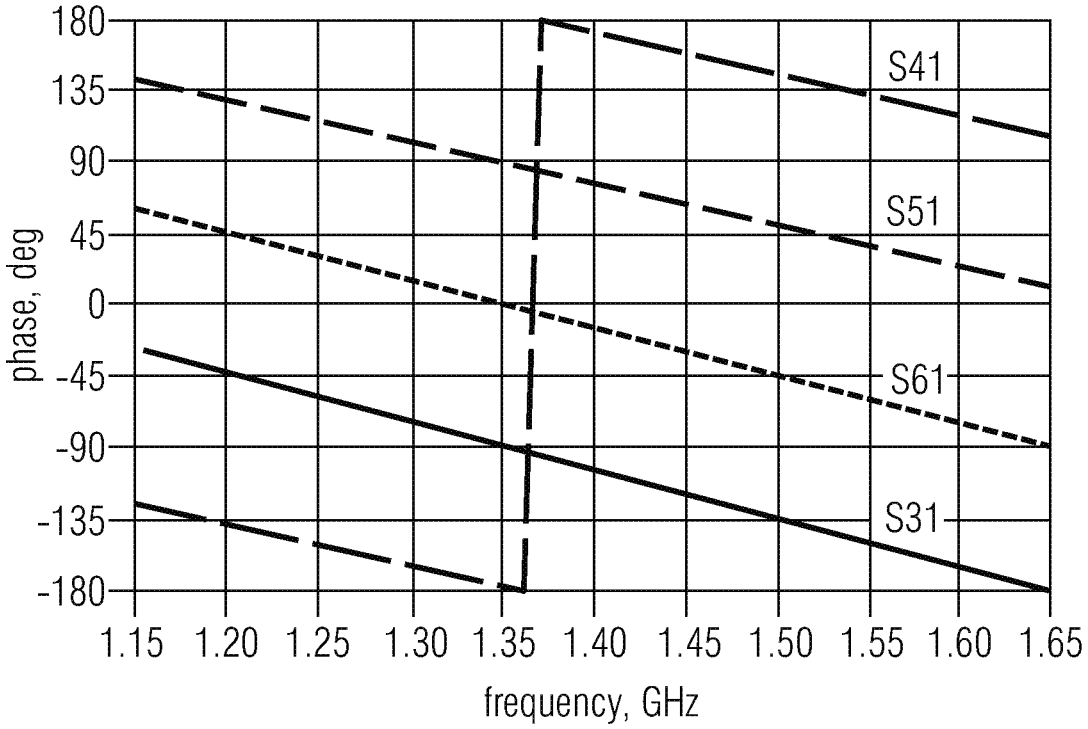

In FIGS. 4*c* and 4*d*, the resulting transmission characteristics for the RHCP mode (cf. FIG. 4*a*) of the circuitry of FIG. 3*a* are illustrated. As can be seen by means of FIG. 4*c*, the amplitude at the outputs 10*a*1 to 10*a*4 is almost constant across the frequency range considered. Also, the phases at the outputs decrease in a linear manner; at the output 10*a*2, a phase jump by 360 degrees occurs at the frequency of 1.35 GHz.

Figure 5A:
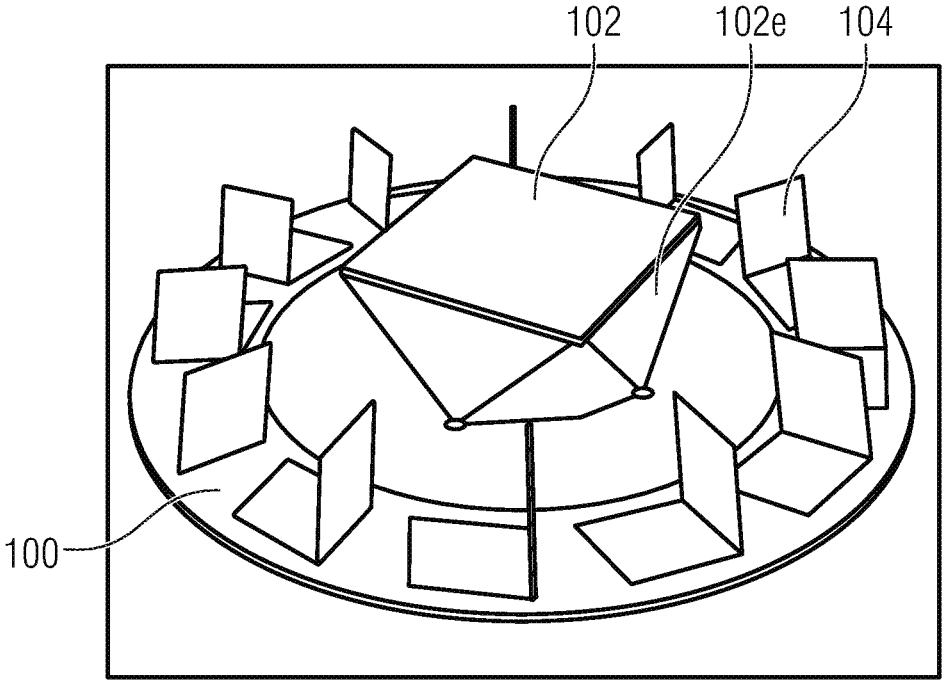
FIGS. 5*a*, 5*b* show schematic representations of antennas for operation with a circuitry of FIG. 1*a*, of FIG. 3*a*, 3*b* or 3*c* in accordance with embodiments.
Figure 5B:
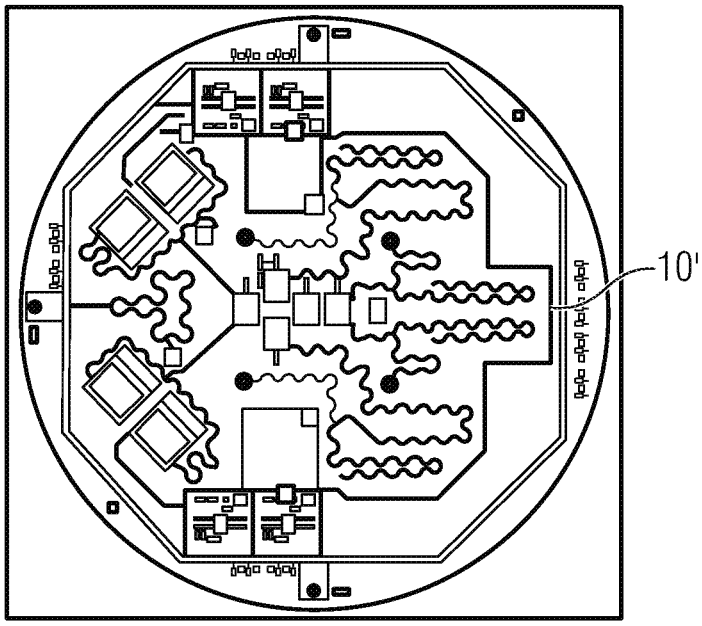

The above-illustrated switching networks 10, 10', 10", 10'" may all be implemented within or outside an annular slot and may be implemented, for example, on two-sided circuit boards. FIGS. 5*a* and 5*b* show two representations in an active dual circular polarized GNSS antenna comprising a feeding network 10' on the bottom side (cf. FIG. 5*b*). The antenna includes a ground disc 100, a centrally arranged batwing radiator 102 which is attached opposite the ground plane 100 via four folded-down corners 102*e*. Additionally, the ground plane 100 also comprises parasitic elements 104 surrounding the batwing radiator 102. The antenna system depicted here firstly exhibits an extended bandwidth with regard to impedance matching, additionally enables better decoupling of the gates, shape of the directional characteristic, cross-polarization suppression and phase-center stability. In addition, more-over, the four-point feeding network is compact, as is clearly seen in FIG. 5*b*, in particular. Due to the positive HF properties, simple and mechanically stable radiator configurations which may be produced at low cost are possible (e.g. broad-band batwing radiators as are depicted here in FIG. 5*a*) (without any large-expenditure balun networks).

Figure 5C:
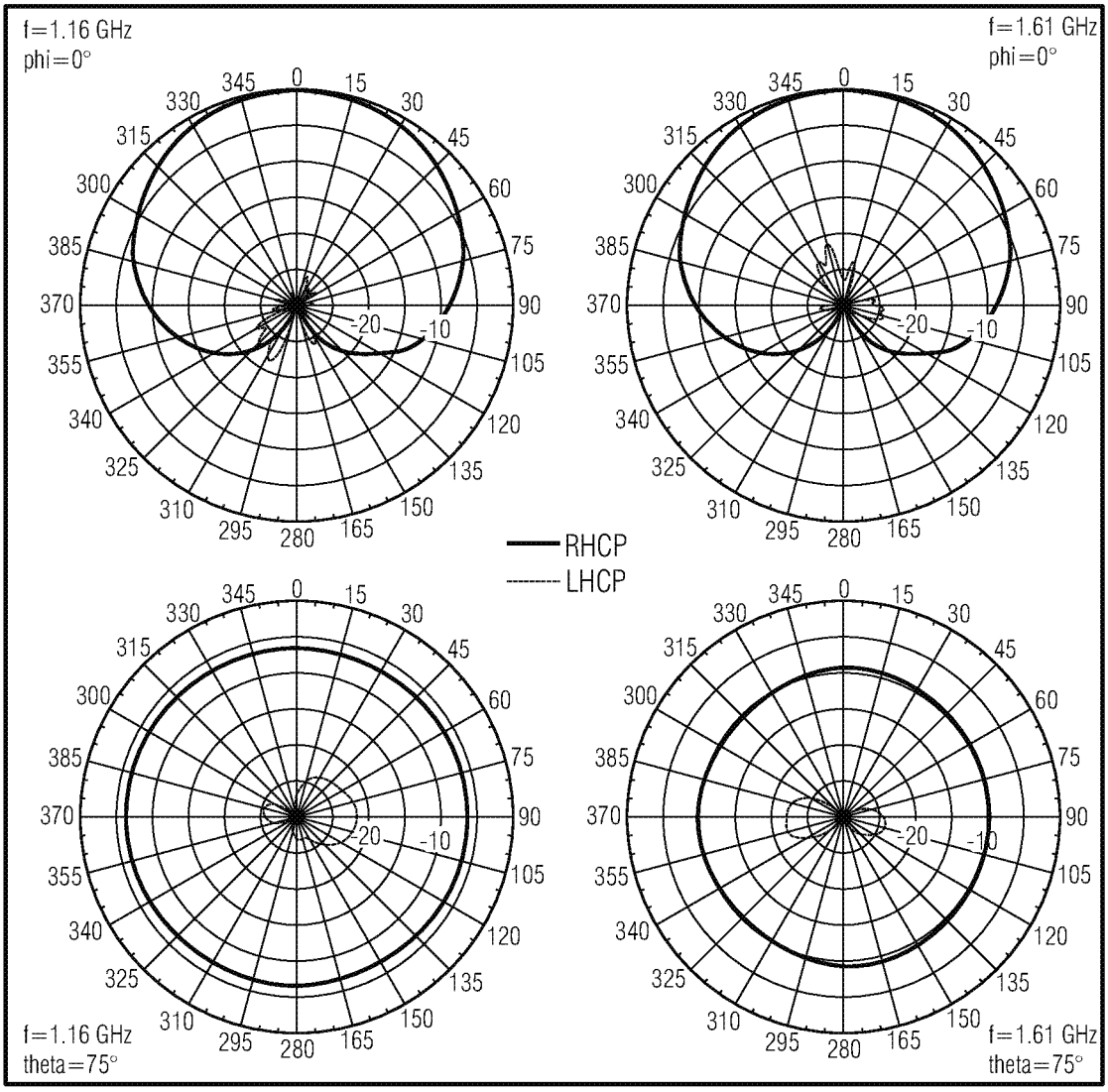
FIG. 5*c* shows four schematic, normalized directional diagrams for illustrating the radiation pattern when using the novel feeding network in accordance with the above embodiments.

Every antenna depicted in FIG. 5*a* is fully polarimetric. As becomes clear, in particular, when comparing FIG. 5*c*, which represents the normalized directional diagrams of the GNSS antenna comprising a switching network in accordance with an embodiment (RHCP path) for a feeding network in accordance with embodiments, with the diagrams of FIG. 5*c*, the feeding-network variant in accordance with embodiments exhibits slightly improved polarization properties.

Figure 6:
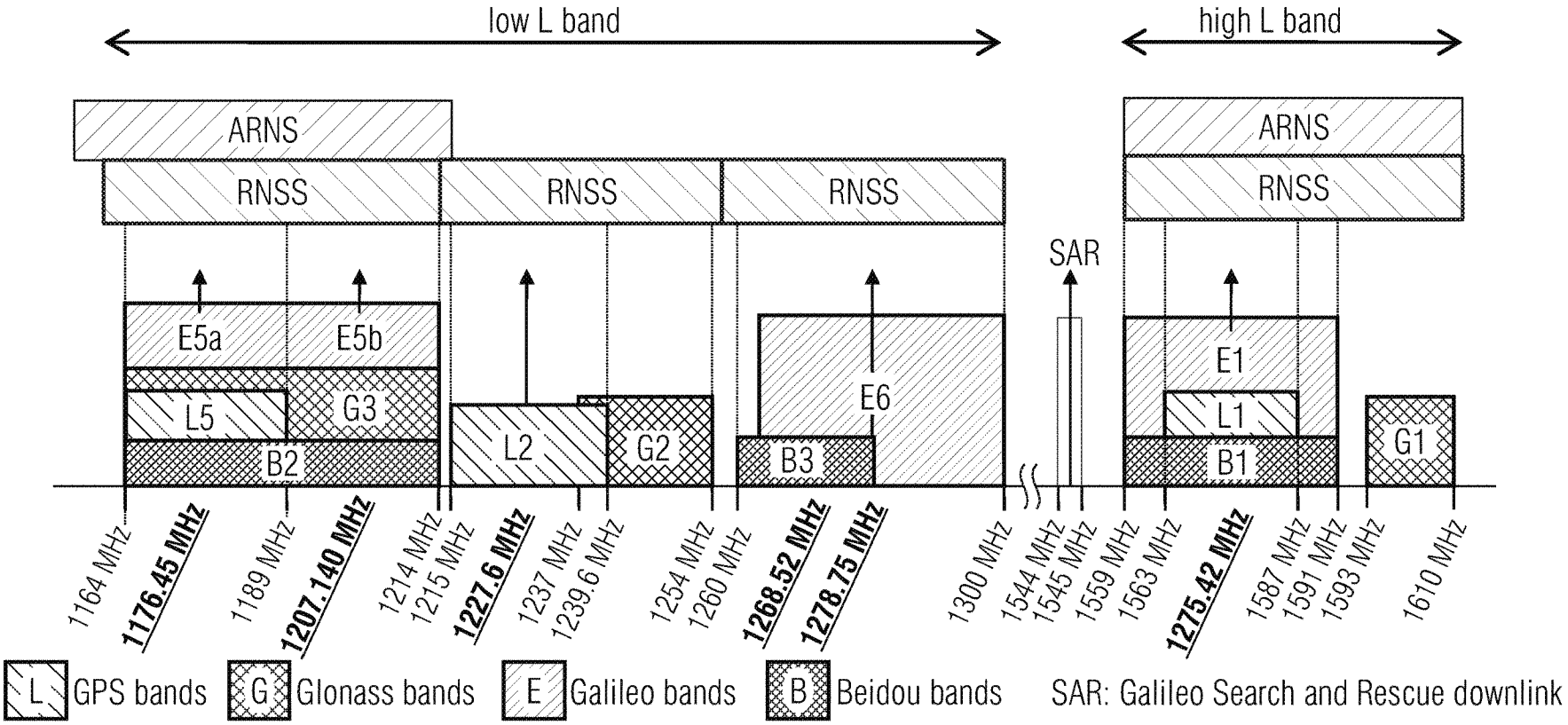
FIG. 6 shows a schematic illustration of the GNSS signals in the L band.
Figure 7A:
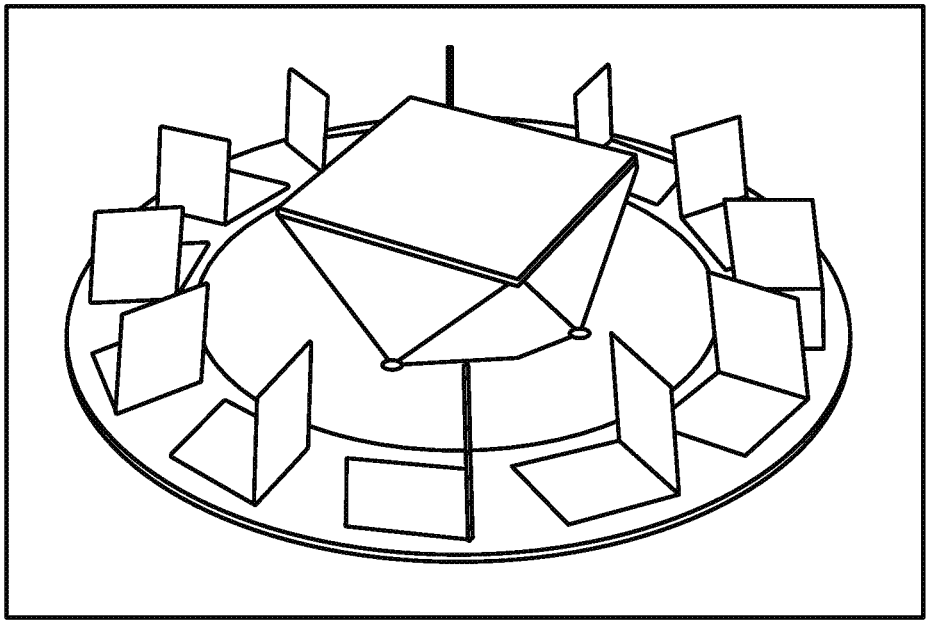
FIGS. 7*a*-7*i* show schematic block diagrams and diagrams for discussing conventional technology.
Figure 7B:
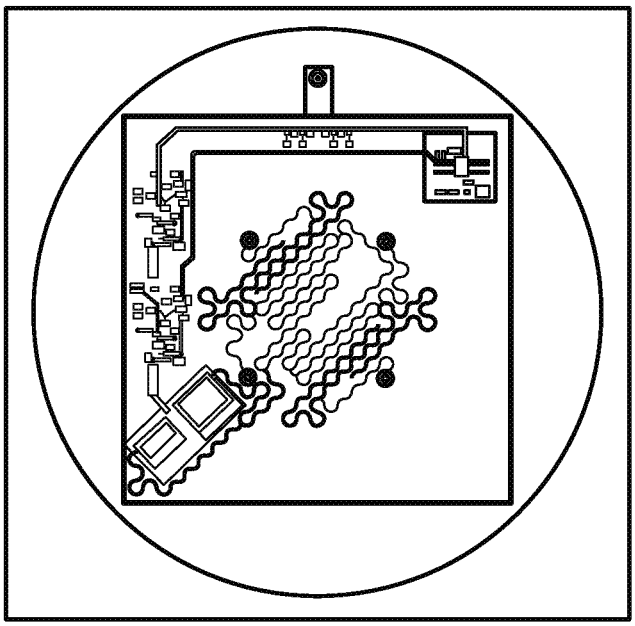
Figure 7C:
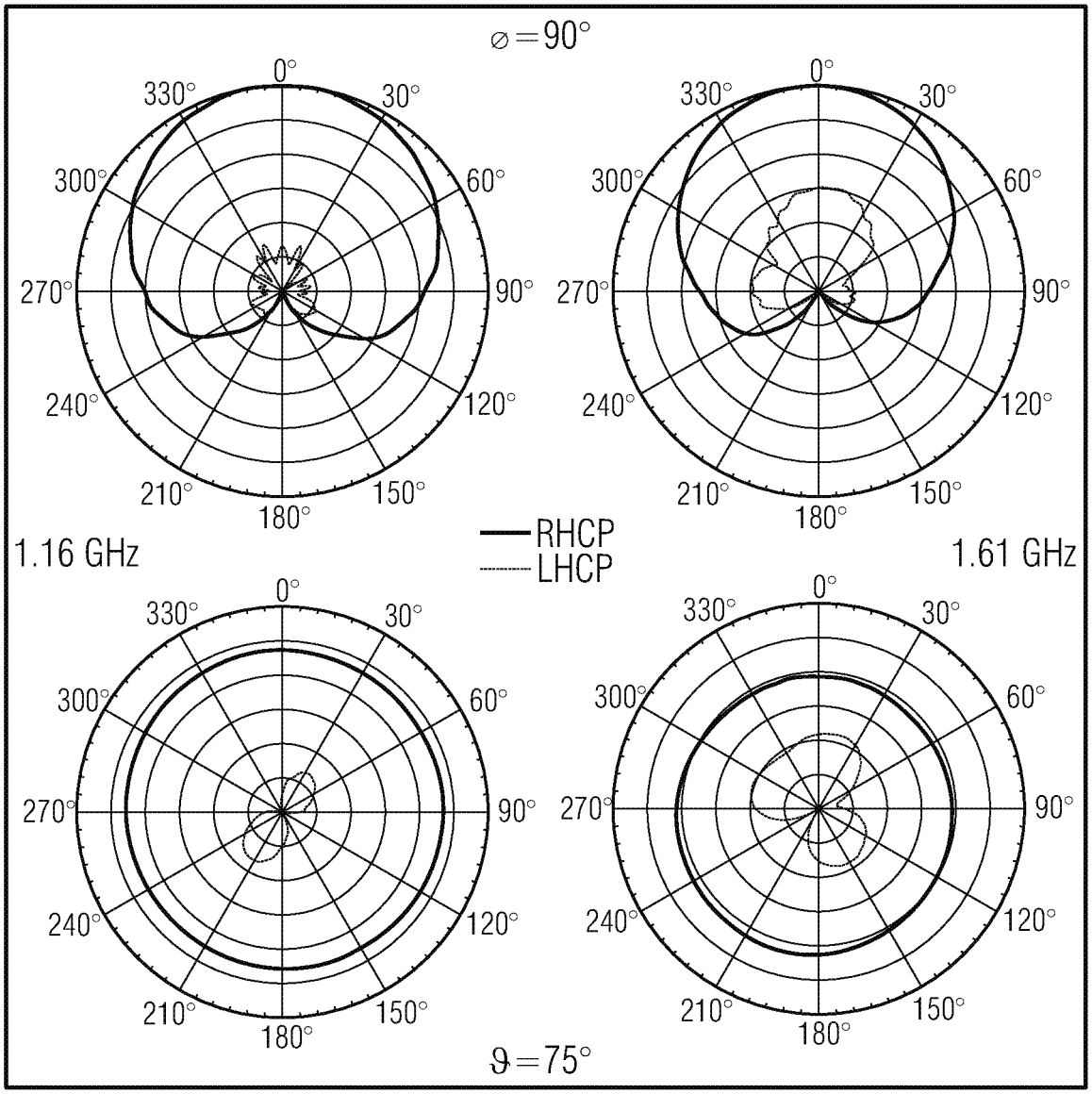
Figure 7D:
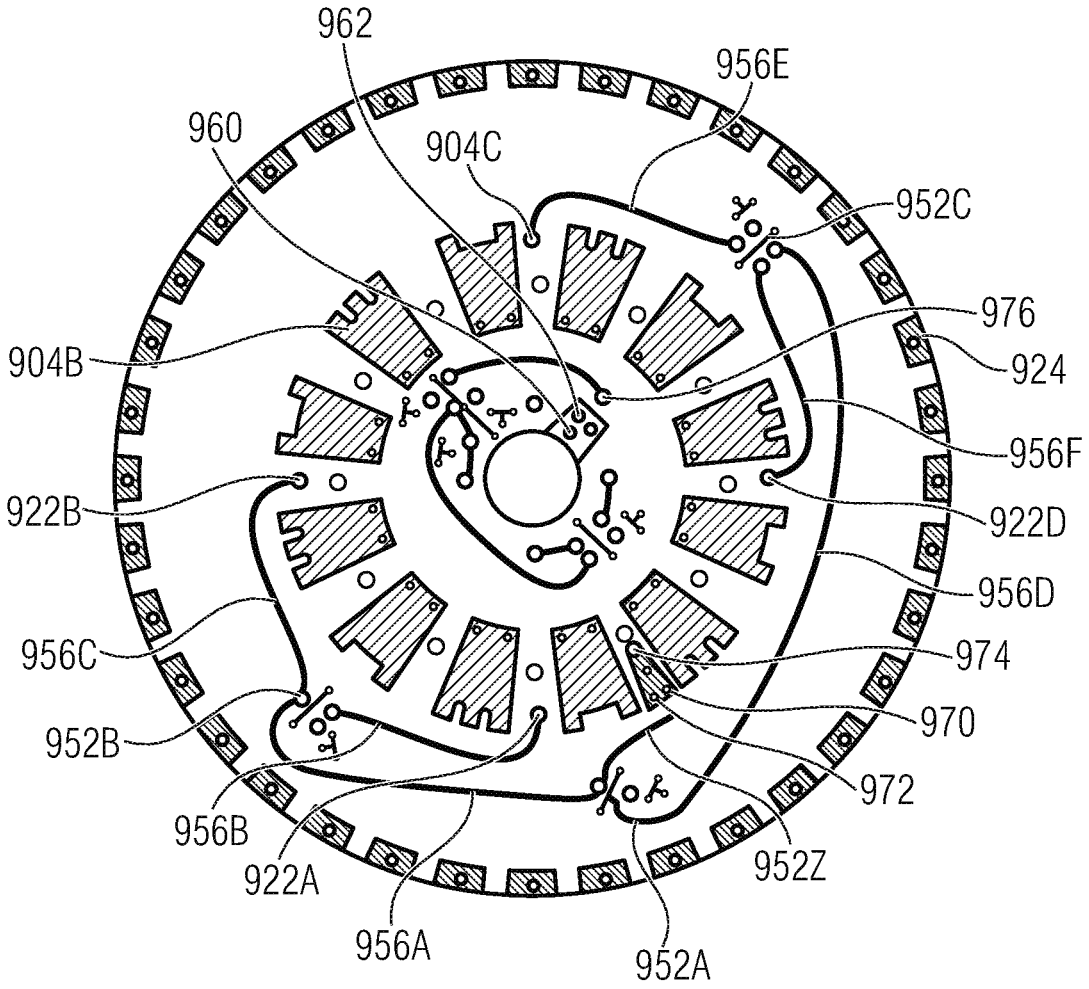
Figure 7E:
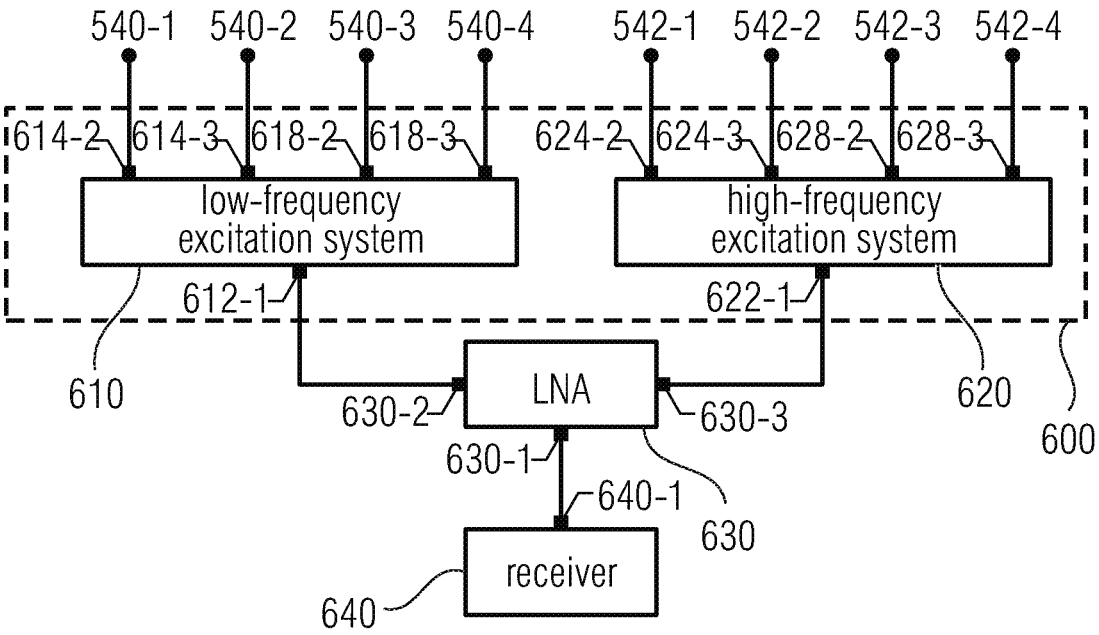
Figure 7F:
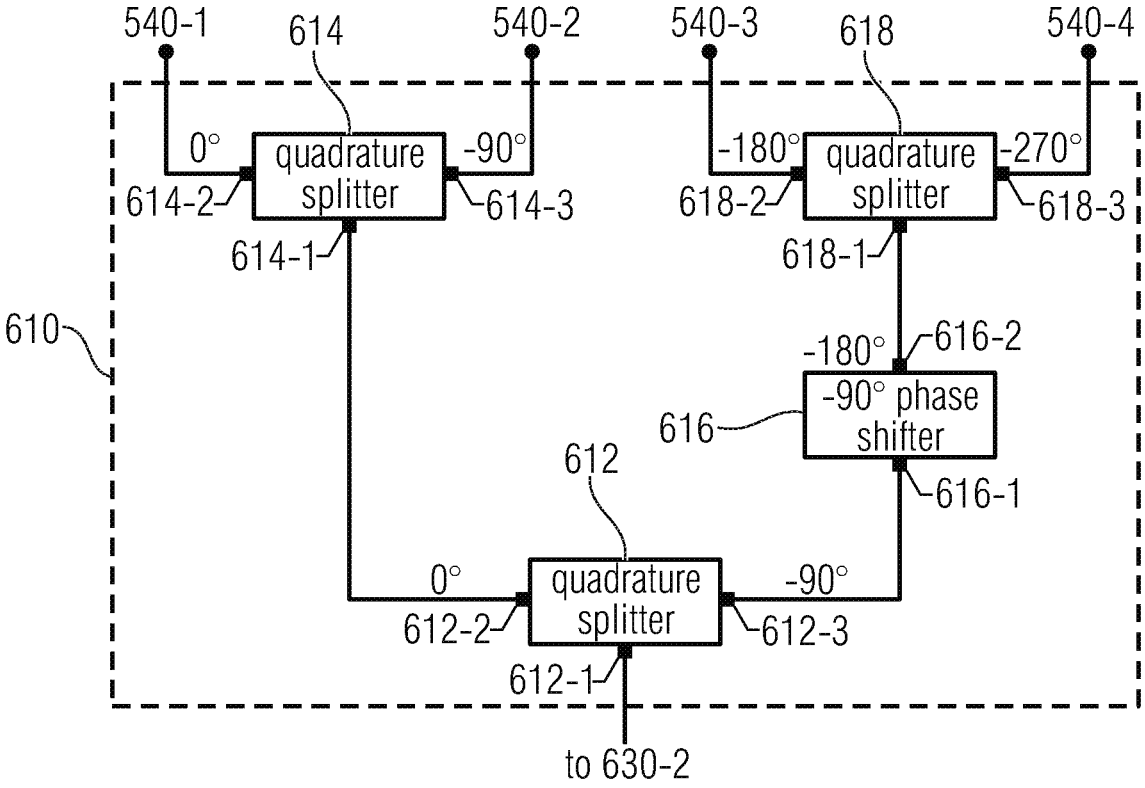
Figure 7G:
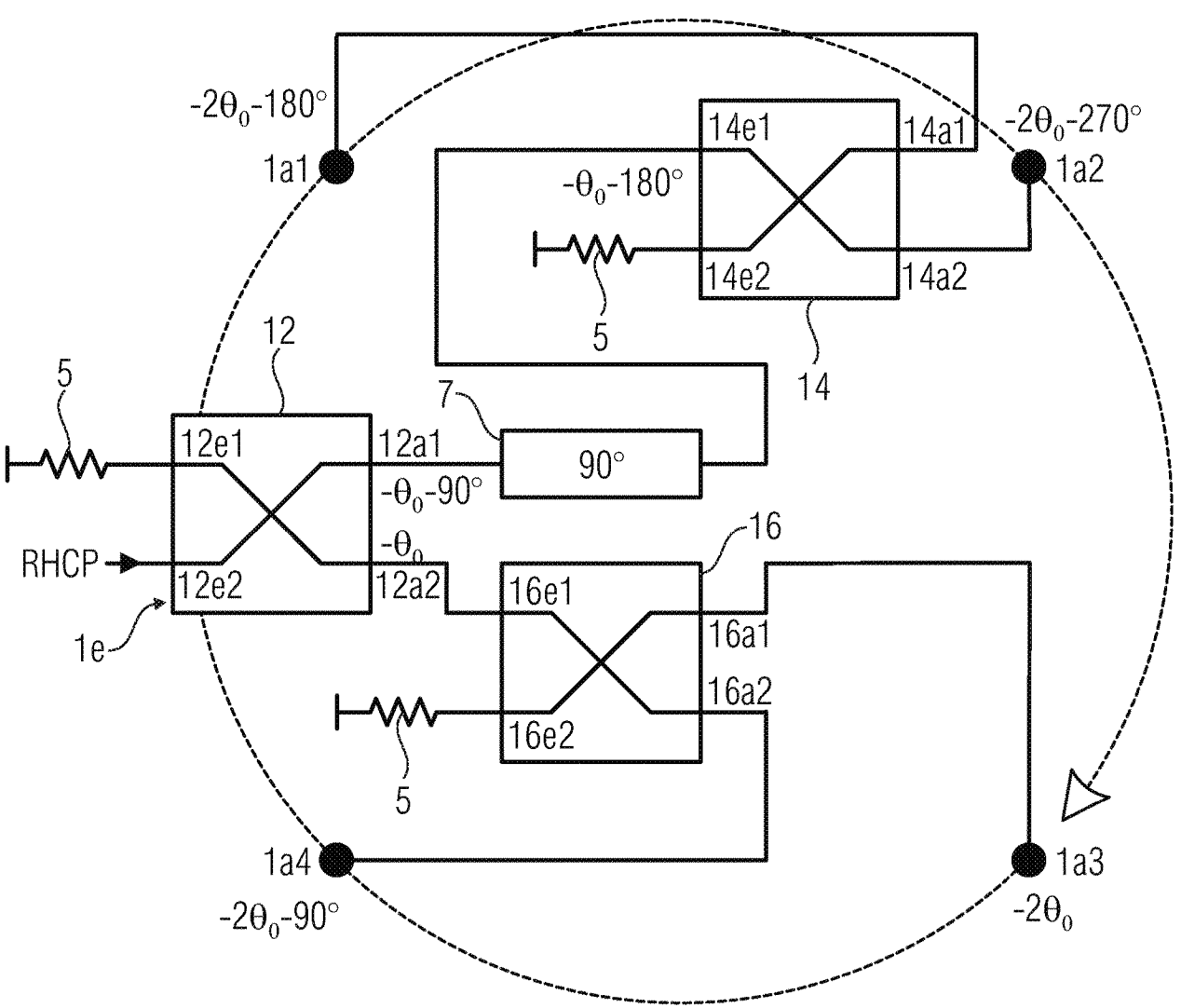
Figure 7H:
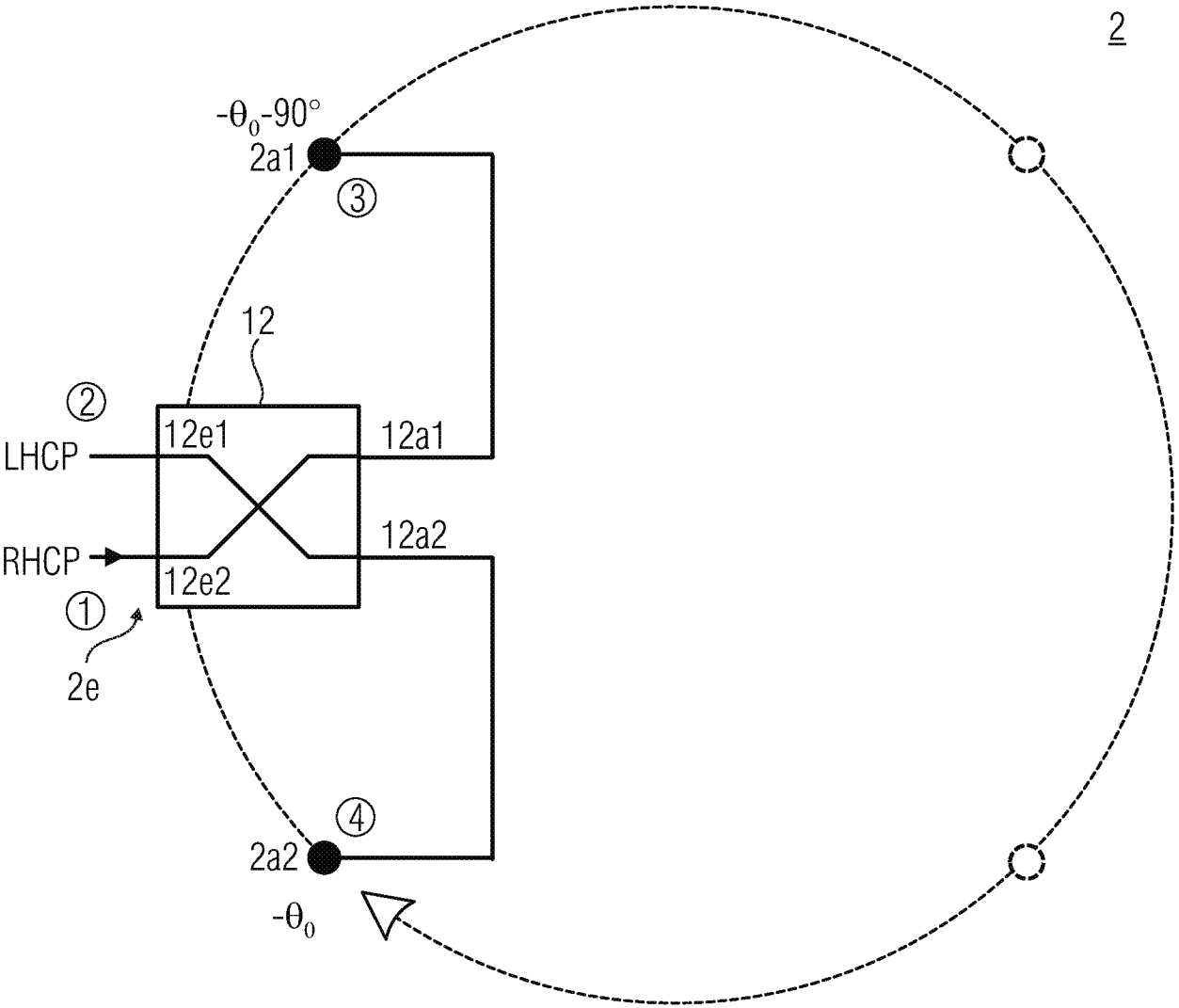
Figure 7I:
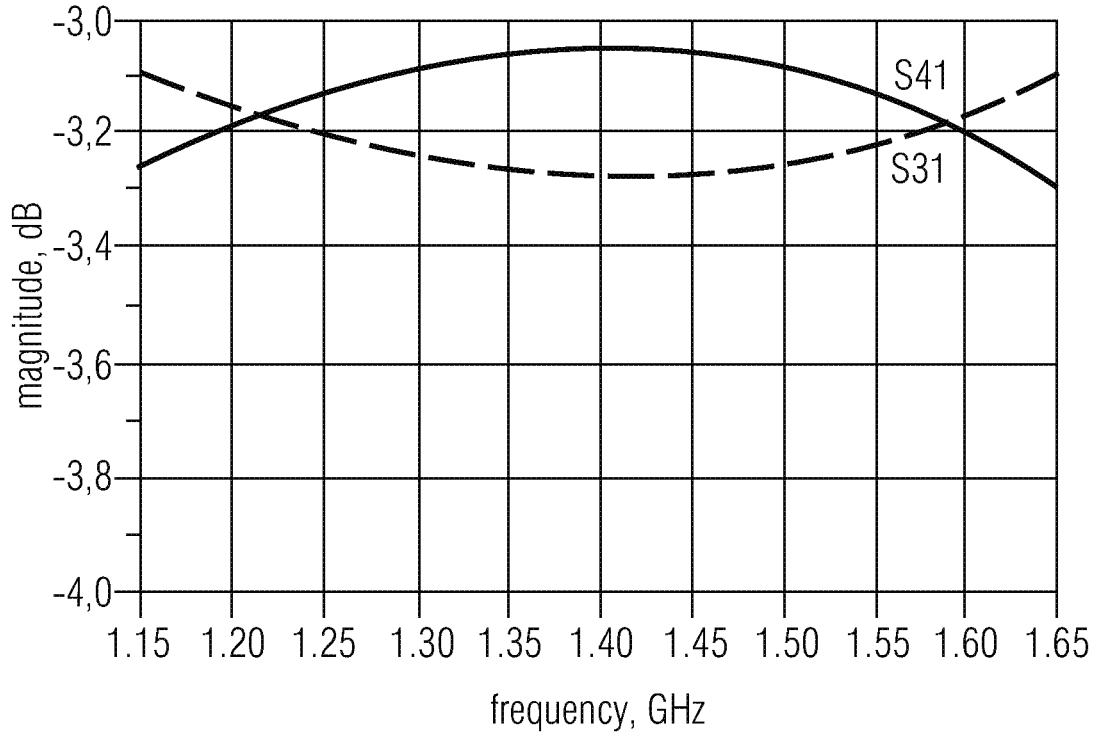
Figure 7I:
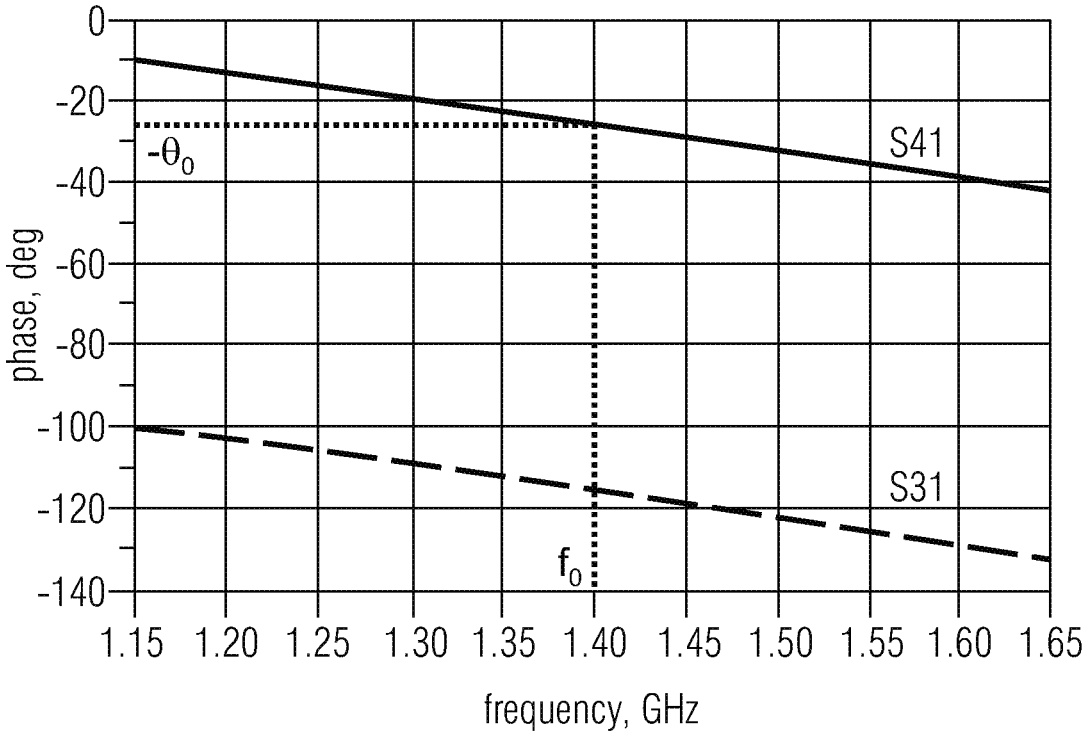

Fields of application for above-illustrated feeding networks are two-gate GNSS antennas for positioning operations, for measurements and navigation, such as the radiator concept of [2], for example. However, generally, all GNSS signals within the L band (cf. FIG. 6) are supported. Possible implementations are dual transceivers (combined RHCP and LHCP operation), but also transceivers for individually operating RHCP only. In this case, the LHCP output is terminated by means of an adapted load. Likewise, LHCP operation only is feasible, in which case the RHCP input will be terminated by means of a load.

It shall be noted here in terms of the above embodiments that the above-illustrated delay elements 7, 7', 7''', or the delay lines 7, 7', 7''', may exhibit different delays, in each case as a function of the argument $\theta_0$, such as, e.g., 90 degrees, 180 degrees, 360 degrees or any other delay. Here, the delay is determined, in accordance with embodiments, by the length of the delay line.

In above embodiments, it was discussed, with regard to arranging the delay lines, that said delay lines may be arranged either at the outputs 10*a*1 and 10*a*4 or 10*a*2 and 10*a*3 or at all four outputs 10*a*1-10*a*4. Other pairs of combinations would also be feasible.

In accordance with embodiments, the above-explained switching networks are configured to be symmetric; each switching network comprising a first path for RHCP signals and a second path for LHCP signals, and each path driving the outputs either on the left (LHCP) with a 90-degrees phase offset, or on the right (RHCP) with a 90-degrees phase offset. As a result, a method of operation is provided in accordance with a further embodiment. Said method of operation includes the central step of utilizing at least one of the two possible paths of the feeding network.

Even though some aspects have been described within the context of a device, it is understood that said aspects also represent a description of the corresponding method, so that a block or a structural component of a device is also to be understood as a corresponding method step or as a feature of a method step. By analogy therewith, aspects that have been described in connection with or as a method step also represent a description of a corresponding block or detail or feature of a corresponding device. Some or all of the method steps may be performed by a hardware device (or while using a hardware device) such as a microprocessor, a programmable computer or an electronic circuit, for example. In some embodiments, some or several of the most important method steps may be performed by such a device.

Depending on specific implementation requirements, embodiments of the invention may be implemented in hardware or in software. Implementation may be effected while using a digital storage medium, for example a floppy disc, a DVD, a Blu-ray disc, a CD, a ROM, a PROM, an EPROM, an EEPROM or a FLASH memory, a hard disc or any other magnetic or optical memory which has electronically readable control signals stored thereon which may cooperate, or cooperate, with a programmable computer system such that the respective method is performed. This is why the digital storage medium may be computer-readable.

Some embodiments in accordance with the invention thus comprise a data carrier which comprises electronically readable control signals that are capable of cooperating with a programmable computer system such that any of the methods described herein is performed.

Generally, embodiments of the present invention may be implemented as a computer program product having a program code, the program code being effective to perform any of the methods when the computer program product runs on a computer.

The program code may also be stored on a machine-readable carrier, for example.

Other embodiments include the computer program for performing any of the methods described herein, said computer program being stored on a machine-readable carrier.

In other words, an embodiment of the inventive method thus is a computer program which has a program code for performing any of the methods described herein, when the computer program runs on a computer.

A further embodiment of the inventive methods thus is a data carrier (or a digital storage medium or a computer-readable medium) on which the computer program for performing any of the methods described herein is recorded.

A further embodiment of the inventive method thus is a data stream or a sequence of signals representing the computer program for performing any of the methods described herein. The data stream or the sequence of signals may be configured, for example, to be transferred via a data communication link, for example via the internet.

A further embodiment includes a processing means, for example a computer or a programmable logic device, configured or adapted to perform any of the methods described herein.

A further embodiment includes a computer on which the computer program for performing any of the methods described herein is installed.

A further embodiment in accordance with the invention includes a device or a system configured to transmit a computer program for performing at least one of the methods described herein to a receiver. The transmission may be electronic or optical, for example. The receiver may be a computer, a mobile device, a memory device or a similar device, for example. The device or the system may include a file server for transmitting the computer program to the receiver, for example.

In some embodiments, a programmable logic device (for example a field-programmable gate array, an FPGA) may be used for performing some or all of the functionalities of the methods described herein. In some embodiments, a field-programmable gate array may cooperate with a microprocessor to perform any of the methods described herein. Generally, the methods are performed, in some embodiments, by any hardware device. Said hardware device may be any universally applicable hardware such as a computer processor (CPU) or a graphics card (GPU), or may be a hardware specific to the method, such as an ASIC.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[1] K. Fletcher (ed.), "GNSS Data Processing, Vol. I: Fundamentals and Algorithms", ESA Communications, ESA TM-23/1, May 2013

[2] DE 10 2007 004 612 B4

[3] A. Popugaev, L. Weisgerber "An Efficient Design Technique for Direction-Finding Antenna Arrays", in Proceedings of IEEE-APS Topical Conference on Antennas and Propagation in Wireless Communications (APWC), Aruba, 2014

[4] EP 2 702 634 B1

[5] U.S. Pat. No. 9,520,651 B2

[6] Data sheet XC1400P-03S, Anaren

[7] US 2007/0254587 A1

[8] A. Popugaev, "Miniaturisierte Mikrosteifenleitungs-Schaltungen bestehend aus zusammengesetzten Viertelkreisringen", N&H Verlag, Erlangen, 2014 (Thesis, TU [University of Technology] Ilmenau).

The invention claimed is:

1. Circuitry for feeding an antenna structure, comprising:

a first input for LHCP signals, a second input for RHCP signals;

four antenna outputs;

a first quadrature hybrid;

second and third quadrature hybrids, and at least two delay lines;

wherein the first quadrature hybrid is coupled, on the input side, to the first and second inputs and is coupled, on the output side, to the second and third quadrature hybrids, wherein the second quadrature hybrid is coupled, on the output side, to two of the four antenna outputs, and wherein the third quadrature hybrid is coupled, on the output side, to two further ones of the four antenna outputs;

wherein the at least two delay lines are arranged at two of the four antenna outputs;

the circuitry comprising fourth and fifth quadrature hybrids connected in series, the fourth quadrature hybrid being connected, on the input side, to the second quadrature hybrid and to the third quadrature hybrid.

2. Circuitry as claimed in claim 1, wherein the second quadrature hybrid is coupled, on the output side, to the first of the four antenna outputs, and the third quadrature hybrid is coupled, on the output side, to the fourth of the four antenna outputs.

3. Circuitry as claimed in claim 1, wherein the first, second and third quadrature hybrids each comprise two inputs.

4. Circuitry as claimed in claim 3, wherein one of the two inputs of the second quadrature hybrid is coupled to a termination resistor, and wherein one of the two inputs of the third quadrature hybrid is coupled to a further termination resistor.

5. Circuitry as claimed in claim 1, wherein each quadrature hybrid comprises two outputs, the second quadrature hybrid being configured to generate a phase offset of 0 degrees at one of the two outputs and to generate a phase offset of 90 degrees at the other of the two outputs.

6. Circuitry as claimed in claim 5, the circuitry comprising two delay lines arranged such that one of the two delay lines connects the output, offset by 90 degrees, of the second quadrature hybrid to one of the four antenna outputs, whereas the other of the two delay lines connects the output, offset by 90 degrees, of the third quadrature hybrid to a further one of the four antenna outputs.

7. Circuitry as claimed in claim 1, wherein the fourth quadrature hybrid is connected to outputs, offset by 0 degrees in each case, of the second and third quadrature hybrids.

8. Circuitry as claimed in claim 1, wherein the fifth quadrature hybrid is connected, on the output side, to the second and third of the four antenna outputs.

9. Circuitry as claimed in claim 8, the circuitry comprising two further delay lines arranged between the fifth quadrature hybrid and the second of the four antenna outputs and between the fifth quadrature hybrid and the third of the four antenna outputs, respectively.

10. Circuitry as claimed in claim 1, the circuitry being configured to be operated in the RHCP mode and in the LHCP mode.

11. Circuitry as claimed in claim 10, wherein in the RHCP mode, the second quadrature hybrid is configured to obtain, from the first quadrature hybrid, a signal offset by 90 degrees by the first quadrature hybrid, and the third quadrature hybrid is configured to obtain, from the first quadrature hybrid, a signal offset by 0 degrees by the first quadrature hybrid;

wherein in the LHCP mode, the third quadrature hybrid is configured to obtain, from the first quadrature hybrid, a signal offset by 90 degrees by the first quadrature hybrid, and the second quadrature hybrid is configured to obtain, from the first quadrature hybrid, a signal offset by 0 degrees by the first quadrature hybrid.

12. Circuitry as claimed in claim 10, wherein in the RHCP mode, the first input is terminated by means of a termination resistor, and wherein in the LHCP mode, the second input is terminated by means of a termination resistor.

13. Antenna arrangement comprising:

an antenna structure comprising four feeding points;

a circuitry for feeding an antenna structure, comprising:

a first input for LHCP signals, a second input for RHCP signals;

four antenna outputs;

a first quadrature hybrid;

second and third quadrature hybrids, and at least two delay lines;

wherein the first quadrature hybrid is coupled, on the input side, to the first and second inputs and is coupled, on the output side, to the second and third quadrature hybrids, wherein the second quadrature hybrid is coupled, on the output side, to two of the four antenna outputs, and wherein the third quadrature hybrid is coupled, on the output side, to two further ones of the four antenna outputs;

wherein the at least two delay lines are arranged at two of the four antenna outputs;

the circuitry comprising fourth and fifth quadrature hybrids connected in series, the fourth quadrature hybrid being connected, on the input side, to the second quadrature hybrid and to the third quadrature hybrid, the four outputs being connected to the four feeding points of the antenna structure.

14. Circuitry for feeding an antenna structure, comprising:

a first input for LHCP signals, a second input for RHCP signals;

four antenna outputs;

a first quadrature hybrid;

second and third quadrature hybrids, and at least two delay lines;

wherein the first quadrature hybrid is coupled, on the input side, to the first and second inputs and is coupled, on the output side, to the second and third quadrature hybrids, wherein the second quadrature hybrid is coupled, on the output side, to two of the four antenna outputs, and wherein the third quadrature hybrid is coupled, on the output side, to two further ones of the four antenna outputs;

wherein a first of the at least two delay lines is arranged at an output of the second quadrature hybrid and a second of the at least two delay lines is arranged at an output of the third quadrature hybrid.

15. Circuitry according to claim 14, wherein the first, the second and the third quadrature hybrids are identical.

16. Circuitry according to claim 14, wherein the first, the second and the third quadrature hybrids are 90 degree quadrature hybrids.

* * * * *